US006845868B1

(12) United States Patent
Krush et al.

(10) Patent No.: US 6,845,868 B1
(45) Date of Patent: Jan. 25, 2005

(54) MULTIFREQUENCY VIBRATORY SEPARATOR SYSTEM, A VIBRATORY SEPARATOR INCLUDING SAME, AND A METHOD OF VIBRATORY SEPARATION OF SOLIDS

(75) Inventors: Iona Krush, Ashdod (IL); Yuri Obodan, Beer Sheva (IL)

(73) Assignee: Vibtec Engineering Ltd., Ashdod (IL)

( * ) Notice: Subject to any disclaimer, the term of this patent is extended or adjusted under 35 U.S.C. 154(b) by 0 days.

(21) Appl. No.: 09/937,593

(22) PCT Filed: Mar. 28, 2000

(86) PCT No.: PCT/IL00/00192

§ 371 (c)(1),
(2), (4) Date: Sep. 28, 2001

(87) PCT Pub. No.: WO00/58031

PCT Pub. Date: Oct. 5, 2000

(30) Foreign Application Priority Data

Mar. 28, 1999 (IL) ..... 129209
Jan. 20, 2000 (IL) ..... 134132
Feb. 8, 2000 (IL) ..... 134444

(51) Int. Cl.[7] ..... B07B 1/42
(52) U.S. Cl. ..... 209/365.4; 209/332; 209/365.1
(58) Field of Search ..... 209/309, 311, 209/315, 317, 325, 326, 331, 332, 365.1, 365.4, 379, 382

(56) References Cited

U.S. PATENT DOCUMENTS 3,029,947 A * 4/1962 Roubal ..... 209/412
3,030,098 A * 4/1962 Roubal ..... 267/153
3,070,230 A * 12/1962 Peterson ..... 209/310
3,796,311 A * 3/1974 Krause ..... 209/275
4,504,386 A * 3/1985 Dyren et al. ..... 209/254
4,839,036 A * 6/1989 Slesarenko ..... 209/315
5,037,537 A 8/1991 Bielagus
5,232,099 A 8/1993 Maynard
5,456,364 A 10/1995 Lambert
5,542,548 A 8/1996 Senapati
6,062,394 A * 5/2000 Bielagus ..... 209/320
6,220,447 B1 * 4/2001 Lambert ..... 209/382

FOREIGN PATENT DOCUMENTS

FR A1-2686812 8/1993

* cited by examiner

*Primary Examiner*—Donald P. Walsh
*Assistant Examiner*—Joseph C Rodriguez
(74) *Attorney, Agent, or Firm*—Birch, Stewart, Kolasch & Birch, LLP

(57) ABSTRACT

A vibratory separator for sorting solids including a housing (12) with an inlet (22) for feeding material, a first oulet (24) for discharging undersized particles, and a second oulet (26) for discharging oversized particles; and one or more screens (28) supported in the housing between the inlet and the first outlet wherein undersized particles pass through the screen and exit through the first oulet and oversized particles do not pass through the screen and exit through the second outlet; including the steps of introducing the solids into the housing via the inlet, imparting to the housing a single frequency vibration (20); and converting the single frequency vibration into a sequence of mechanical pulses applied to an interface apparatus by a multifrequency vibratory systems (48), thereby to generate a multifrequency vibration to one or more screens to cause de-agglomeration of the masses to prevent blockage of the one or more screens by particles.

47 Claims, 26 Drawing Sheets

MULTIFREQUENCY VIBRATORY SEPARATOR SYSTEM, A VIBRATORY SEPARATOR INCLUDING SAME, AND A METHOD OF VIBRATORY SEPARATION OF SOLIDS

This application is the national phase under 35 U.S.C. § 371 of PCT International Application No. PCT/IL00/00192 which has an International filing date of Mar. 28, 2000, which designated the United States of America.

FIELD OF THE INVENTION

The present invention generally relates to methods and apparatuses of material separation and, more particularly, to vibratory sieve separation of particulate solids up to preselected sizes from a material having particles of different sizes, and including the separation of particles from bulk materials and from slurries.

DEFINITIONS

Unless specifically stated otherwise, the following terms used in the specification and claims, should be understood as follows:

The term "vibratory separator," should be understood as meaning any vibratory separator, screen, sieve or sifter, having one or more single frequency excitation sources.

The term "rigid," should be understood as meaning that the element or apparatus to which it refers has a lowest natural frequency greater than the forced frequency of the structure in which the element or apparatus is mounted.

BACKGROUND OF THE INVENTION

Many methods of separating particulate materials from bulk materials and slurries employ a vibrating sieve, over which material is moved so that smaller particles may pass through the openings while the larger particles pass thereallong. The sieve is activated by one or several vibrators which generate vibration of the sieve surface at predetermined frequency and amplitude. These methods are generally ineffective, however, when applied to certain materials, such as wet materials, fine powders with a significant tendency to agglomerate, highly cohesive powders, and generally, so-called difficult to sieve materials; and the sieves used for sieving of such materials are prone to clogging.

There are also known separation methods based on vibratory excitation of the sieve surface by two or more vibrators applying simultaneous superposed vibrations with different forced frequencies and amplitudes to a sieve, and consequently, to material providing for screening thereby. These methods provide an increase in screening efficiency and a reduction in clogging of the sieve meshes. Such methods employ apparatus having two or more vibrators for driving a screen, wherein one or more vibrators provide low frequency vibratory excitation of the screen, with a relatively large amplitude, while one or more other vibrators provide vibration of a smaller amplitude, and at a higher frequency.

By way of example, U.S. Pat. No. 5,232,099 discloses a screening apparatus and method, wherein there are provided low amplitude vibrations having a frequency in the range 1000–7000 vpm, and at an amplitude in the range 600–1350 rpm. High frequency vibrations, which are generated by several vibrators, are applied directly to a sieve, while low frequency vibrations are transmitted to the sieve via a housing. An advantage of this method is relatively low wear of the sieve and an increased capacity. Disadvantages include the necessity of provision of several additional vibrators; and the concentration of vibratory energy transmitted to sieve, and subsequently to the material, within narrow frequency zones. The absence of wide band spectrum excitation hinders desired disintegration of powder agglomerates.

There are also known vibration separation methods which employ double frequency excitation. These methods combine use of a low frequency vibration, typically in the range 5–60 Hz, with ultrasonic excitation, provided by means of an electromechanical transducer fed by an electronic generator, which provide high-frequency sine vibrations of a sieve. Such vibration is typically within the 20–50 kHz band, with a small amplitude. Ultrasonic vibration may be either continuous or intermittent. By way of example, the SONOSCREEN system of Telsonic AG, Bronschhofen, Switzerland, is an ultrasonic sieving system for fine powders, having ring-shaped resonators to provide an even micro-oscillation. In more detail, the sieve separator has a sieve assembly which includes a sieve frame, and a sieve fabric which is tensioned and bonded to the frame. The ultrasonic transducer is rigidly fastened to the frame inside the screening area. The frame has a natural frequency which is close to the forced frequency of the ultrasound generator. The sieve assembly is fixed inside the separator housing, thus providing combined vibration of the screen deck at both low and high frequencies. Disadvantages of this system include relatively low energy transfer to the sieve fabric, and insufficient de-agglomeration efficiency.

Another example of a screening system employing double frequency excitation, is provided by U.S. Pat. No. 5,542,548. In this patent, there is provided a screening system having a resiliently mounted frame, a low frequency vibratory drive coupled to the frame, a screen extending across and resiliently mounted to the frame, and a plurality of high frequency drives mounted rigidly to the periphery of the screen, operative to vibrate the screen at a frequency in the approximate range 10,000 to 50,000 Hz. The screen is adapted to be responsive to high frequency vibrations in a plate-like manner. Fine mesh screens may be supported by backing screens, coarse mesh screens or perforated plates, bonded or unbonded.

Various systems, generally similar to the above system, employ an ultrasonic transducer, this being directly fastened via a washer to the center of a round sieve. One such system is the Vibrasonic® 2000 Mesh Deblinding System, manufactured by Russell Finex Limited, of Russell House, Browells Lane, Feltham, Middlesex TW13 7EW, England.

A further type of system is exemplified by the Ultrasonic Circular Screen Separator, manufactured by Kason Corporation, 67–71 East Willow St. Millburn, N.J. 07041-1416, U.S.A. This separator combines low and high frequency excitation of a sieve, by means of a pair of ultrasonic transducers which act on the sieve surface, via a pair of metal rings. The transducers, which transform electric signals provided by a electronic generator, are fastened to a support on the screen frame. The transducer's downward force and position can be adjusted. This makes possible the provision of dual vibration excitation to the sieve fabric of standard screens. Furthermore, there is provided a low frequency vibration via a vibratable housing, by means of a coaxially aligned, unbalanced vibrator motor; and a high frequency vibration, directly applied to the sieve fabric from an ultrasonic transducer. The VORTI-SIV® division of MM Industries, Inc., of 36135 Salem Grange Road P.O. Box 720, Salem, Ohio 44460, manufactures an Ultrasonic De-blinding System, which superimposes an ultrasonic high frequency excitation on a low frequency excitation sieving system.

Among the main disadvantages of the above-described dual-frequency separation methods is the absence of wide band spectrum excitation, and a low transference of mechanical energy to the screen, causing low performance.

Yet further known is the unblocking of sieves by impact action of different shock means upon a sieve element. Disclosed in U.S. Pat. No. 5,301,815 is a screening device, which comprises a vibrating frame to which a vibrating housing is attached, supporting a vibrating screen. Below the screen are attached a number of fixed bars, as well as a number of movable bars, each held at the extremity of two arms attached by a flexible connection. The vibrating housing is driven by a first electric motor used during the normal screening process and a second electric motor which rotates at a lower speed than that of the other motor for unblocking the device by maintaining the movable bars in resonance so that they strike the lower surface of the vibrating screen.

U.S. Pat. No. 4,288,320 describes unclogging a sieve in a vibratory screen by use of a plurality of weighted springy arms. The arms are formed integrally with and so as to extend laterally, to either or both sides of a resilient mounting strip that is disposed in touching contact with and beneath, the lower surface of the screen. The vibrating action of the vibratory screen induces an oscillating movement in resiliently mounted arms so as to give rise to a rapping action of the weighted ends of the arms against the undersurface of the screen, thereby to loosen material plugging the screen openings, and so as to unclog them. A disadvantage of this arrangement is the intensive wear of the sieve and arms caused by the motion of these elements when abrasive materials are processed.

SUMMARY OF THE INVENTION

It is thus an aim of the present invention to provide an improved method of separation of fine and ultra-fine powder materials, and a vibratory separator for size classification thereof, characterized by continuous self-cleaning and providing disintegration of particle agglomerates during use.

It is another object of the present invention to provide an improved vibratory separator having an increased capacity when compared with prior particle classification systems, and which improves the quality of end products formed of difficult-to-screen materials which have a tendency to plug or peg vibratory sieve openings with particles of a size similar to that of the sieve openings, or which tend to clog the sieve openings with sticky or wet particles.

It is still another object of the present invention to increase the capacity and quality of the products providing sufficient level of multifrequency mechanical excitation of the sieve which utilize high peak acceleration of the sieve surface.

It is still another object of the present invention to provide an efficient separation method and a machine utilizing vibration modes of the sieve which are generally stable even under conditions of significant fluctuation of fed particulate material.

It is still another object of the present invention to provide apparatus for adapting single-frequency vibratory separators to multifrequency, non-clogging separators.

It is still another object of the invention to provide reliable multifrequency converter apparatus for a vibratory separator as an integral device therewith, so as to simplify assembling and tuning thereof.

There is thus provided, in accordance with a preferred embodiment of the present invention, one or more multifrequency vibratory adapter systems for use with a vibratory separator which includes a housing formed with an inlet for material to be screened, a first outlet for discharge of undersized particles, and a second outlet for discharge of oversized particles, one or more screens supported in the housing between the inlet and the first outlet such that material entering the housing through the inlet engages the one or more screens, and wherein undersized particles pass through the one or more screens and exit the housing through the first outlet, whereas oversized particles do not pass through any of the screens and exit the housing through the second outlet; and a source of single frequency vibratory excitation for exciting the separator so as to screen particulate material provided thereto.

There is further provided, in accordance with an additional embodiment of the invention, a vibratory separator which includes:

- a housing formed with an inlet for material to be screened, a first outlet for discharge of undersized particles, and a second outlet for discharge of oversized particles;
- one or more screens supported in the housing between the inlet and the first outlet such that material entering the housing through the inlet engages at least a first of the screens, and wherein undersized particles pass through the screens and exit the housing through the first outlet, whereas oversized particles do not pass through at least one of the screens, and so exit the housing through the second outlet;
- a source of single frequency vibratory excitation for exciting the separator so as to screen particulate material provided thereto; and
- a multifrequency vibratory adapter system.

In accordance with the present invention, each multifrequency vibratory adapter system is associated with a predetermined one of the one or more screens, and includes:

- one or more interface apparatuses mounted in excitation transmitting contact with an associated screen; and
- one or more multifrequency converter units, each arranged in excitation conducting association with a single interface apparatus, operative to produce a multifrequency excitation when exposed to a single frequency excitation, thereby to cause a corresponding multifrequency excitation of the interface apparatus, and thus also, of its associated screen.

Additionally in accordance with a preferred embodiment of the invention, each multifrequency converter unit includes one or more actuator elements for conducting excitation energy to the one or more interface apparatuses, and resilient attachment apparatus for attaching each actuator element to a support portion;

- and the adapter system also includes apparatus for mounting the support portion in association with the housing, and one or more elastic buffers, arranged between the one or more actuator elements and the at one or more interface apparatuses, for adjusting in non-linear fashion, the characteristics of the multifrequency excitation transmitted therebetween.

Further in accordance with a preferred embodiment of the invention, the apparatus for mounting the support portion includes resilient mounting apparatus for mounting the support portion in resiliently excitable association with the housing.

Additionally in accordance with a preferred embodiment of the invention, the resilient attachment apparatus is characterized by having non-linear force displacement characteristics, and is operative to produce a multifrequency excitation of the one or more actuator elements, when subjected to a single frequency excitation, so as to provide an excitation of amplitude sufficient to cause the one or more actuator elements to strike the one or more buffers.

Further in accordance with a preferred embodiment of the invention, the resilient attachment apparatus includes a pair of integral resilient mountings, each having first and second resilient bush portions, wherein each resilient bush portion includes first and second portions arranged for relative rotation about a common axis, and wherein the first portions of the first and second resilient bush portions are connected to each other, a first of the second portions is connected, at least indirectly, to the support portion, and a second of the second portions is connected to one of the one or more actuator elements.

Additionally in accordance with a preferred embodiment of the invention, each actuator element is mounted relative to one interface apparatus such that, when in an at-rest position, each actuator element is in non-touching, association with the interface apparatus, and, when subjected to the excitation, actuator element repeatedly strikes and thus causes a corresponding multifrequency excitement of the one or more interface apparatuses, thereby to cause a corresponding multifrequency excitation of the associated screen, and of any particulate material sought to be screened thereby.

Further in accordance with a preferred embodiment of the invention, each actuator element is mounted relative to one of the one or more interface apparatuses such that, when in an at-rest position, the actuator element is in touching, association therewith, and, when subjected to the multifrequency excitation, each actuator element repeatedly strikes and thus causes a corresponding excitation of the one or more interface apparatuses, thereby also to cause a corresponding multifrequency excitation of the associated screen, and of any particulate material sought to be screened thereby.

Additionally in accordance with a preferred embodiment of the invention, each interface apparatus is configured and arranged with respect to the screen associated therewith such that, when subjected to the multifrequency excitation, each interface apparatus is operative to transmit the multifrequency excitation to a predetermined area of the screen, through which particulate material is sought to be passed.

Further in accordance with a preferred embodiment of the invention, each interface apparatus is formed of two or more members, of which at least one is adjustable with respect to the at least one other, thereby adjusting the characteristics of the multifrequency excitation of the associated screen.

Additionally in accordance with a preferred embodiment of the invention, each multifrequency converter unit has a rigid casing formed thereabout, and each interface apparatus includes at least a portion of the casing.

Further in accordance with a preferred embodiment of the invention, each interface apparatus further includes an interface element arranged in direct excitation contact with the screen associated therewith, and further includes intermediate interface apparatus for transmitting multifrequency excitation from the casing to the interface element.

Additionally in accordance with a preferred embodiment of the invention, the intermediate interface apparatus includes a rigid intermediate element connecting between the casing and the interface element.

Further in accordance with a preferred embodiment of the invention, the intermediate interface apparatus includes a resilient intermediate element connecting between the casing and the interface element.

Additionally in accordance with a preferred embodiment of the invention, there is also provided apparatus for tensioning each of the one or more screens.

Further in accordance with a preferred embodiment of the invention, the apparatus for tensioning each of the one or more screens includes apparatus for supporting the interface element thereagainst.

Additionally in accordance with a preferred embodiment of the invention, the apparatus for tensioning is adjustable.

Further in accordance with a preferred embodiment of the invention, the vibratory separator also includes one or more reflecting apparatuses, arranged inside the housing above the upper surface of the screen and in spaced association with respect to the screen, and the at least one reflecting apparatus has one or more feed opening for passage of particulate material to the upper surface of the screen, Preferably, each such reflecting apparatus is configured as a shell having formed therein the one or more feed openings, the periphery of the shell is hermetically sealed with respect to the periphery of the screen associated therewith, and the normal distance between the upper surface of the screen and the lower surface of the shell is more than the relative amplitude of the screen and less than the half of the height of the free flight of agglomerated particles under the upper surface of the screen in the absence of the reflecting apparatus.

Further, the shell is preferably formed as flat plate, which is generally parallel to the plane of the screen, associated therewith, and the upper cover is configured as reflecting apparatus for shattering particle agglomerates impacting thereagainst and for promotion of passage of small particles through the screen.

In accordance with yet a further embodiment of the invention, there is provided a method of separating particulate solids of larger and smaller sizes from each other in a vibratory separator having a housing formed with an inlet for material to be screened, a first outlet for discharge of undersized particles, and a second outlet for discharge of oversized particles; and one or more screens supported in the housing between the inlet and the first outlet such that material entering the housing through the inlet engages the one or more screens, and wherein undersized particles pass through the screen and exit the housing through the first outlet, whereas oversized particles do not pass through the one or more screens and exit the housing through the second outlet; wherein the method includes the following steps:

introducing the solids to be separated into the housing via the inlet;

imparting to the housing and thus also to the solids, via the one or more screens, a single frequency vibration, thereby to induce vibratory transportation of particulate solids along the one or more screens such that undersize particles pass therethrough towards the first outlet, and such that oversize particles pass therealong towards the second outlet; and converting the single frequency vibration of the housing, in excitation transmitting association with the one or more screens, into a sequence of mechanical pulses applied to an interface apparatus, thereby to generate a multifrequency vibration of the screen and thus also of masses of agglomerates in engagement with the one or more screens, thereby to cause de-agglomeration of the masses and so also as to prevent blockage of the one or more screens by particles.

Additionally in accordance with an embodiment of the invention, the mechanical pulses are imparted unilaterally towards the one or more screens.

Further in accordance with a preferred embodiment of the invention, the mechanical pulses are applied unilaterally away from the one or more screens.

Additionally in accordance with a preferred embodiment of the invention, the step of generating a multifrequency excitation includes the step of generating mechanical pulses from different sources, and to apply the mechanical pulse therefrom so as to have different phase shifts relative to the phase angle of the single frequency vibration of the housing.

Further in accordance with an embodiment of the invention, the mechanical pulses are imparted towards the one or more screens and away therefrom.

Additionally in accordance with an embodiment of the invention, the mechanical pulses acting towards the one or more screens, and the pulses imparted away therefrom are of different respective durations.

Further in accordance with an embodiment of the invention, the mechanical pulses acting towards the one or more screens, and the pulses imparted away therefrom are of different, respective, magnitudes.

Additionally in accordance with an embodiment of the invention, in the step of generating, the mechanical pulses are imparted at an angle $\beta$ relative to the plane of each of the one or more screens, wherein $0<\beta<90$ degrees.

Further in accordance with an embodiment of the invention, the step of generating multifrequency excitation includes the excitation of different portions of each of one or more screens under differing excitation parameters.

In accordance with yet a further preferred embodiment of the invention, there is provided a method of separating particulate solids of larger and smaller sizes from each other, as described herein, wherein the vibratory separator additionally includes one or more reflecting apparatuses, also as described herein. The method includes the additional steps of causing the disintegration of particle agglomerates multiple collisions thereof in a space between the screen and the reflecting apparatus associated therewith, and providing air pressure pulsations in the space between the screen assembly and the reflecting apparatus pulsations, thereby to force small particles through the openings of the screen.

BRIEF DESCRIPTION OF THE DRAWINGS

The present invention will be more fully understood and appreciated from the following detailed description, taken in conjunction with the drawings, in which.

DETAILED DESCRIPTION OF THE INVENTION

Figure 1:
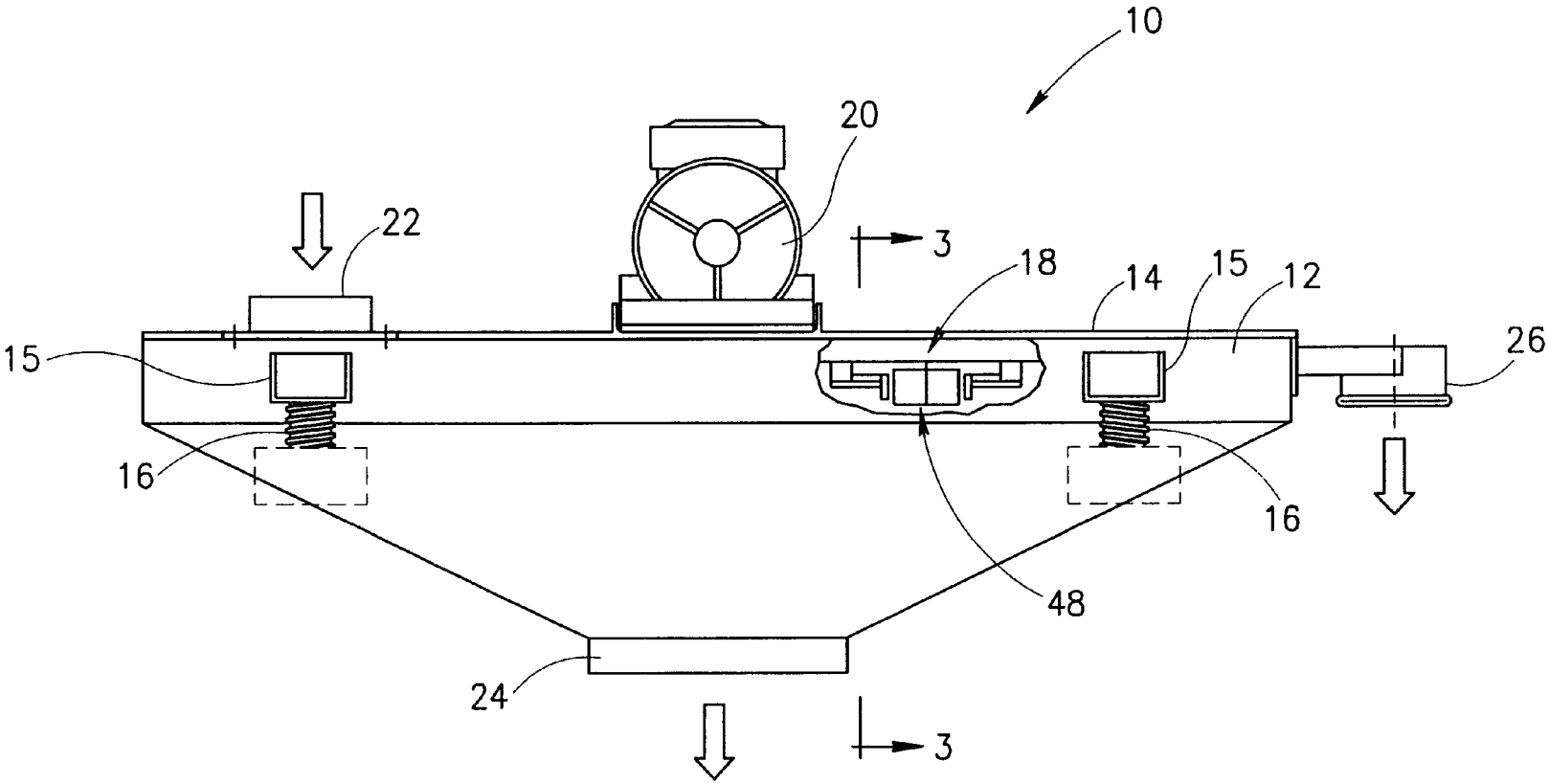
FIG. 1 is a partially cut-away side view of a self-cleaning vibratory separator having mounted therein the multifrequency adapter system of the present invention.
Figure 2:
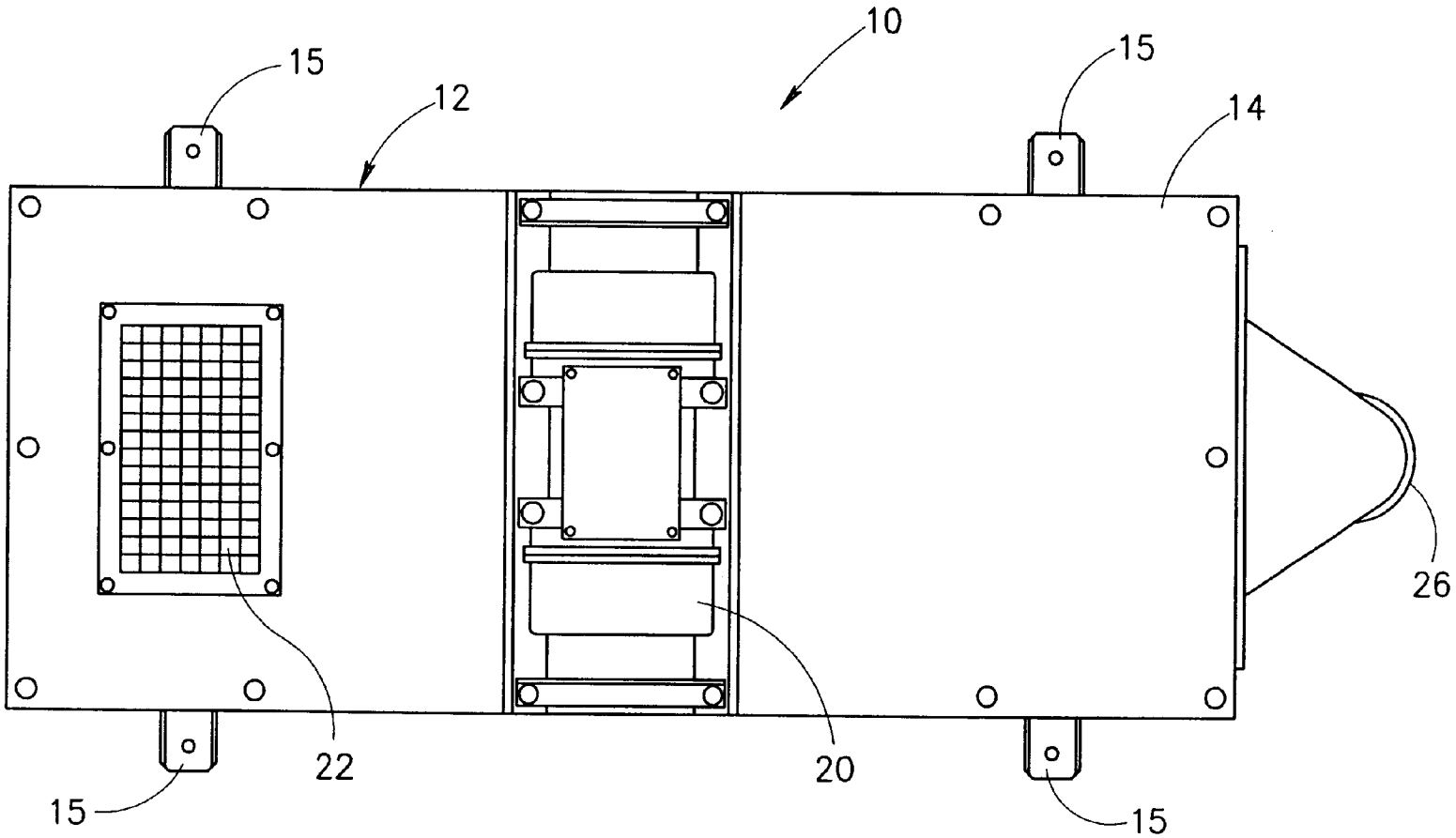
FIG. 2 is a plan view of the separator of FIG. 1.

In the context of the present invention, described herein, the term "elastic buffer" should be understood to mean the provision of one or more elastic portions arranged in either touching or non-touching association between two solid portions, arranged to permit the intermittent formation and closing of a gap therebetween, giving rise to elastic collisions therebetween. Such elastic parts are usually formed from rubber, polyurethane or other elastomer materials. "Elastic buffers" thus described form a non-linear, unilateral, or non-holding, elastic constraint.

Referring now to FIGS. 1–3A, there is shown a vibratory separator, referenced generally 10, constructed and operative in accordance with a preferred embodiment of the present invention. The present invention is intended primarily for screening of powder materials having a tendency to agglomerate, and which typically have a particle size in the range 0.1–150 microns.

The separator 10 includes a housing 12 having a cover 14, a screen assembly 18 supported in housing 12, and a vibratory motor or exciter 20, mounted onto cover 14 of housing 12. Motor 20 is typically any suitable vibratory motor having an operating speed in the range 750–3000 rpm. Housing 12 has attached thereto a plurality of flange supports 15, via which it is mounted onto any suitable support surface (not shown) via resilient supports 16, such as suitable springs, thereby to permit a suitable excitation to be set up in the separator 10 while insulating the support surface therefrom. It will be appreciated that, as an alternative to the illustrated spring mountings, housing 12 may be suspended from an appropriate support via elastic suspension elements. An inlet 22 for ingress of material to be screened, is provided in cover 14; a first outlet 24, located beneath screen assembly 18, is provided in housing 12 for exit of undersized material passing through the screen assembly; and a second outlet 26 is provided in housing 12, typically spaced longitudinally away from inlet 22, for discharging oversize material from separator 10.

It will be appreciated that there is used a multi-deck assembly, for example, such as shown and described hereinbelow in conjunction with FIG. 15, a plurality of second outlets 26 may be provided, wherein only the particles passing through the screen having the smallest mesh size exit the first outlet 24.

In accordance with the present invention, separator 10, while having typically a single source 20 of single frequency excitation, operates as a multifrequency separator, by the mounting therein of a multifrequency vibratory adapter system, constructed and operative in accordance with the present invention. In accordance with a first embodiment of the invention, separator 10 may be an existing separator, which is retrofitted by the addition of the system of the invention. In accordance with an alternative embodiment of the invention, however, separator 10 may constructed from the outset so as to be a multifrequency separator. The precise nature of the adapter system of the present invention will be understood and appreciated from the description below.

Figure 3A:
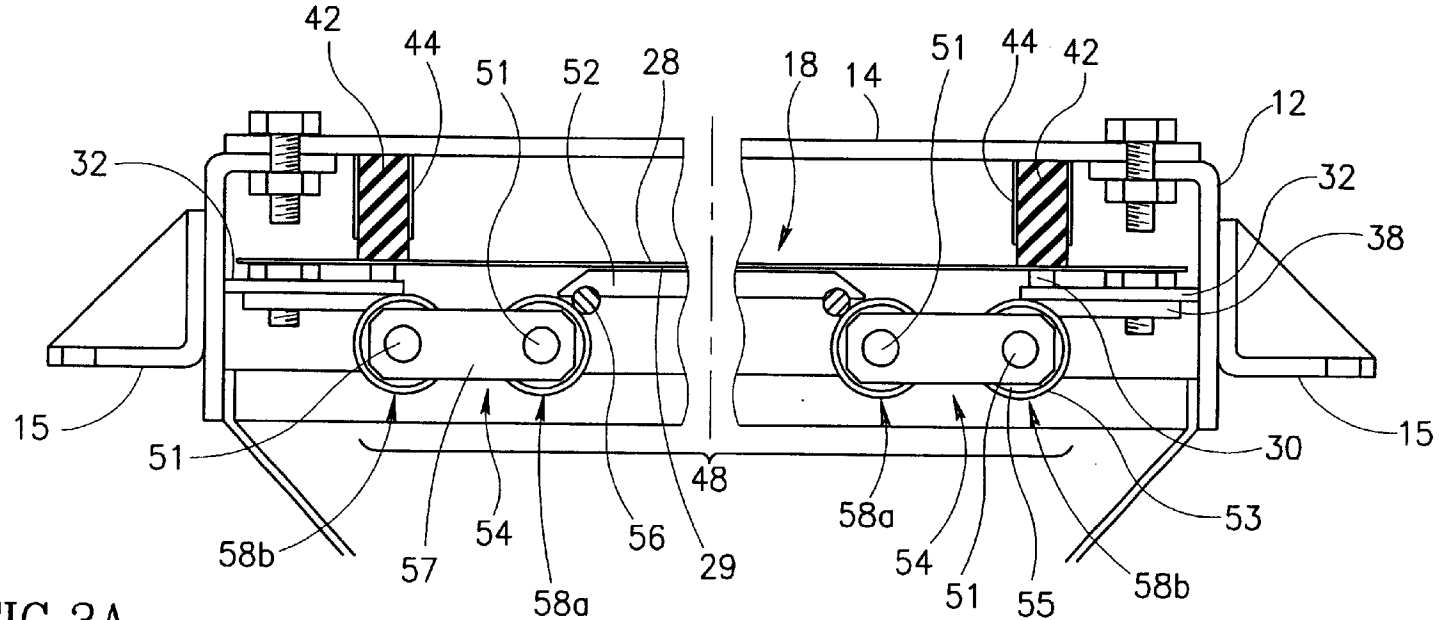
FIG. 3A is a cross-sectional view of the separator of FIGS. 1 and 2, showing in detail the vibratory separator seen in FIG. 1, and taken along line 3—3 therein.

Accordingly, referring now particularly to FIG. 3A, it is seen that screen assembly 18 includes a screen element 28 (seen also in FIG. 1B), which is supported in housing 12 by way of suitable support flanges 32; and a protective elastic, gasket-type element 30 is disposed between screen element 28 and support flanges 32, rigidly mounted onto housing 12. Screen element 28 is of a predetermined appropriate mesh size, typically in the range 600–50 mesh having openings in the range 20–300 microns.

Figure 3B:
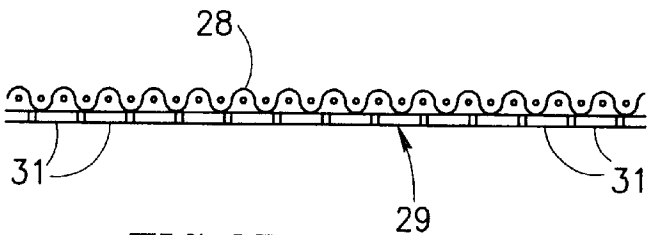
FIG. 3B is an enlarged, schematic, cross-sectional view of the screen and interface apparatus seen in FIG. 3A.

Referring now also to FIG. 3B, mounted beneath screen element 28 is the multifrequency vibratory converter system of the present invention. The illustrated multifrequency adapter system includes interface apparatus 29, which is employed as part of screen assembly 18, so as to be arranged in excitation transmitting contact with screen element 28; and multifrequency converter apparatus 48, shown schematically in FIG. 1, arranged in excitation association with interface apparatus 29.

Multifrequency converter apparatus 48 is constructed such that, in the presence of a single frequency excitation, such as provided by excitation source 20, it provides a multi-frequency output excitation, which is transferred to interface apparatus 29, which transmits the multifrequency excitation to the screen element 28. It has been found by the present Inventors that a multifrequency vibration is not only very effective in de-aglommerating even ultrafine powders, but, also, in preventing blockage of the screen element, per se.

Interface apparatus 29 may be of any suitable construction so as to transmit the multifrequency excitation produced by multifrequency converter apparatus 48 to screen element 28. By way of example, it may be formed as one or more layers of punched metal, or, alternatively, of a coarse sieve. In view of the fact that interface apparatus 29 is intended to transmit an excitation force to the screen element 28, while covering, in the present embodiment, all or most of the surface area thereof, interface apparatus 29 is formed with openings 31 (FIG. 3B) of significantly greater dimensions than the openings formed in screen element 28. The respective dimensions of interface apparatus 29, element 30, and flanges 32; and the mass and bending stiffness of interface apparatus 29, are predetermined so as to retain screen element 28 in position without applying thereto significant tension, thus providing extended wear and useful life thereof. Screen element 28 may be made of any suitable mesh or other screen material, including a suitable wire mesh of stainless steel, brass, or the like, or a suitable polymeric material, such as nylon.

As seen in FIG. 3A, in order to prevent material to be screened from bypassing the 'active' area of the screen, there are preferably also provided a pair of resilient sealing elements 42, each of which is confined in a rigid seating 44 extending downwardly from cover 14, and between cover 14 and elastic element 30. It will be appreciated that, as the material to be screened enters into housing 12 through inlet 22 (FIGS. 1 and 2), which is located above screen assembly 18, at least one or more multifrequency converter apparatuses 48 are provided beneath distributing interface apparatus 29.

Further as seen in FIG. 3A, each multifrequency converter apparatus 48 is formed of at least one rigid actuator element 52 suitably located with respect to interface apparatus 29. When a plurality of actuator elements 52 are provided, these are spaced transversely to the direction of flow of screened material, and along interface apparatus 29, parallel thereto and in spaced relation therewith.

The number of multifrequency converter apparatuses 48, and the shape and dimensions of actuator elements 52 are preferably such that the actuators 52 provide coverage of substantially the entire area of screen element 28. While the actuators 52 are themselves rigid, they are supported on resilient mounts, referenced generally 54, so as to enable the development of a predetermined multifrequency oscillatory motion of actuators 52 when motor 20 (FIGS. 1 and 2) is operated.

The resilient mounts 54 are typically formed of elastic chain links 58*a* and 58*b*, such as a pair of suitably connected elastomer bushes. Each link 58 is preferably formed of a metal sleeve 53 in which is located an elastomeric core 55, through which extends a generally rigid axle 51. Each pair of bushes 58*a* and 58*b* is connected by a rigid connector element 57, and, in the illustrated embodiment, each pair of mounts 54 supports an actuator 52 associated therewith to housing 12 via support flanges 32. Typically, actuator 52 is welded or otherwise rigidly connected, via an intermediate connector element 56, to outer sleeve 53 of the innermost links 58*a*, while the outermost links 58*b* are welded or otherwise rigidly connected to rigid connector plate 38, bolted or otherwise secured to support flanges 32. A suitable connector member, similar to connector element 57, is provided on the far side of the mounts 54 (not shown) so as to provide suitable mechanical strength thereto.

When the single frequency vibratory motor 20 is operated, the one or more multifrequency converter apparatus 48 are excited by a translational motion of the housing 12, and actuators 52 supported on resilient mounts 54 oscillate in relation to housing 12 and sieve assembly 18. At predetermined points of their oscillations patterns, the actuators 52 collide with the interface apparatus 29 at significant relative velocity. As a major portion of the kinetic energy of actuators 52 is thus transferred thereby to screen assembly 18 generally, and to screen element 28, in particular, the actuators 52 provide self-cleaning of screen assembly 18, and, due to vibratory fluidization simultaneously therewith, de-agglomeration of the material to be screened is also caused.

It will be appreciated that the bending stiffness of interface apparatus 29 is selected so as to be sufficient for transferring predetermined impact acceleration in the form of a multifrequency waveform vibration to all portions of the screen element 28, thus preventing clogging and blinding of the openings, and providing disintegration of particle agglomerates. These advantages of the present invention are provided as a result of employing of links 58*a* and 58*b*, particularly in the form of elastomer bushes in resilient mounts 54, in which high deformation energy is generated in a confined space.

Among advantages that have been found by the Inventors in the above-described construction, are the following:

1. Self-cleaning and agglomeration prevention are performed continuously during operation of the separator, thereby enabling continuous use, without having to stop for periodic cleaning.

2. The above-described support of the screen assembly provides free mounting of a fine screen, even without applying thereto any substantial tension, thus reducing wear and fatigue thereof, and consequently providing it with an extended life prior to replacement.

3. The cleaning and anti-agglomeration characteristics of the separator of the present invention have been found to be retained even under an increase in the supply loading thereto of material to be screened.

As mentioned above, in accordance with a preferred embodiment of the invention, multifrequency converter apparatuses 48 are arranged transversely to the path of the material to be screened, as it moves from inlet 22 to outlet 26. In accordance with an alternative embodiment of the invention, however, multifrequency converter apparatuses 48 may be arranged parallel to this path, or arranged at any angle thereto.

In accordance with an embodiment of the present invention, actuator 52 may be covered by an appropriate lining pad (not shown), attached to the surface of actuator 52 brought into contacted with screen element 28. The lining, which acts a buffer element between actuator 52 and screen element 28, serves both to protect the screen element, and at the same time, assists in regulating the multifrequency excitation energy spectrum transferred thereto, so as to achieve a desired sieving and self-cleaning. Typically, the lining pad is made from a low wear material such as polyurethane rubber or the like.

It will be appreciated by persons skilled in the art that, in accordance with an alternative embodiment of the invention, the actuators 52 may form part of or be replaced by a rigid network or coarse screen. As a further alternative, the actuators 52 may have fastened resiliently to upper portions thereof elastic or rigid bars. Preferably, all or part of the surface of the interface apparatus 29 which is contacted by actuators 52, is covered by an appropriate lining made from wear-proof material.

For screening of different types of material, and in a case in which the interface apparatus 29 is a coarse rigid screen, it may be preferable to tension it similar to the way in which a prior art screen is tensioned. In this case, the fine mesh screen element 28 of the present invention may be superimposed over the coarse screen, under little or no tension.

Elastic bushes such as described above, are known in the art and, for example, may be of the Silent Block type of elastic bushes, such as those sold by Monroe-Clevite Elastomers, of Napoleon, Ohio, U.S.A, or the MEGI HL Bushes, sold by Phoenix of Hamburg, Germany.

Figure 4A:
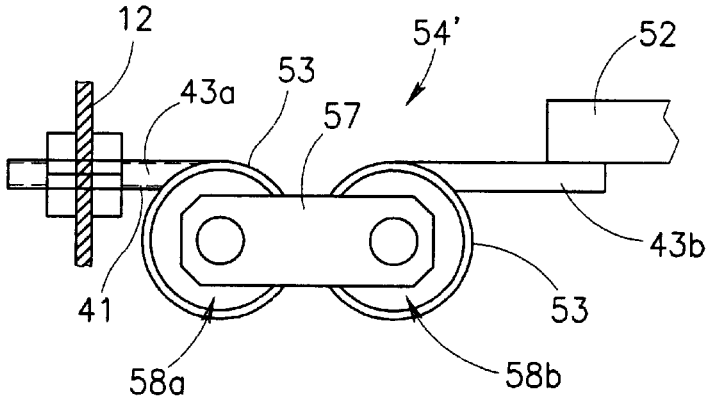
FIGS. 4A–4C are side views of different types of resilient attachment apparatus forming part of the multifrequency converter assembly seen in FIG. 3, formed in accordance with various embodiments of the inventions.
Figure 4B:
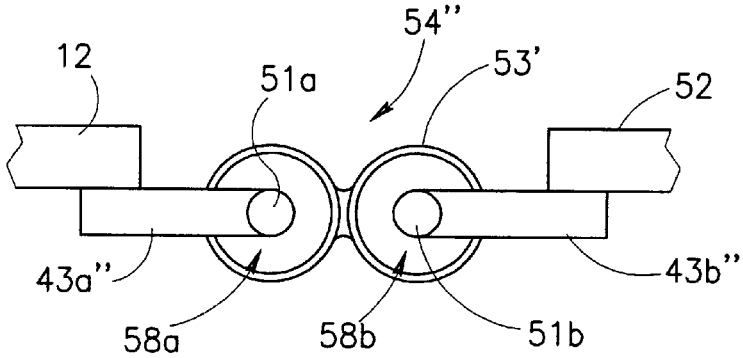
Figure 4C:
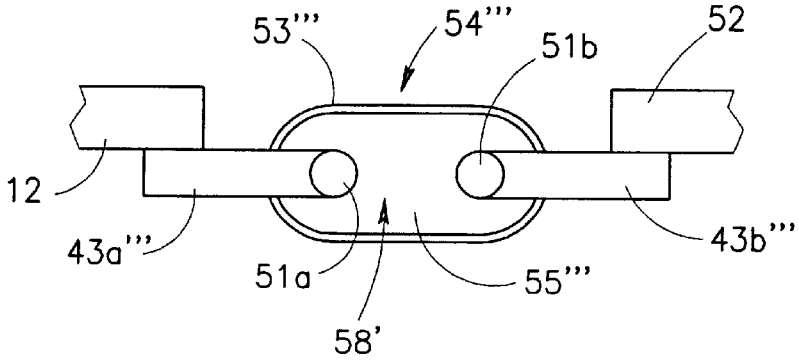

Referring now to FIGS. 4A–4C, there are shown various alternative resilient mount constructions which may be used in place of the resilient mounts 54, shown and described above in conjunction with FIG. 3A. For the purpose of simplicity, portions or components of the illustrated constructions, having counterpart portions or components in FIG. 3A, are denoted by similar reference numerals, and bearing additional suffixes, as necessary.

Referring now initially to FIG. 4A, the illustrated resilient mount 54' has a pair of elastomer bushes 58*a* and 58*b*, wherein a first bush 58*a* has a first fixed bracket portion 43*a* having formed thereon a screw thread 41 for threaded fastening to the illustrated portion of housing 12; and a second bush 58*b* attached to actuator 52 via a second fixed bracket portion 43*b*. Bracket portions 43*a* and 43*b* are preferably attached to outer sleeves 53 of bushes 58*a* and 58*b*, directly, as by welding, although, as shown and described above in conjunction with FIG. 2, one or more intermediate members (not shown) may be employed.

Referring now to FIG. 4B, the illustrated resilient mount 54" has a pair of elastomer bushes 58*a* and 58*b* of which the outer sleeves thereof are formed as an integral member 53', inherently defining a predetermined intra-axial spacing. A first axle 51*a* is attached to housing 12 via a first bracket 43*a*", and a second axle 51*b* is attached to actuator 52 via a second bracket 43*b*". Formation of resilient mount 54" in this manner, as a single, integral unit, simplifies assembly and maintenance of the multifrequency converter apparatuses 48.

Referring now to FIG. 4C, in the illustrated resilient mount 54'" the pair of bushes is replaced by a single bush 58', in which a single elliptical sleeve 53'" encloses a unitary elastomeric core 55'" through which extend axles 51*a* and 51*b*. A first axle 51*a* is attached to housing 12 via a first bracket 43*a*', and a second axle 51*b* is attached to actuator 52 via a second bracket 43*b*', thus providing a simplified, reliable resilient mount construction.

Figure 5:
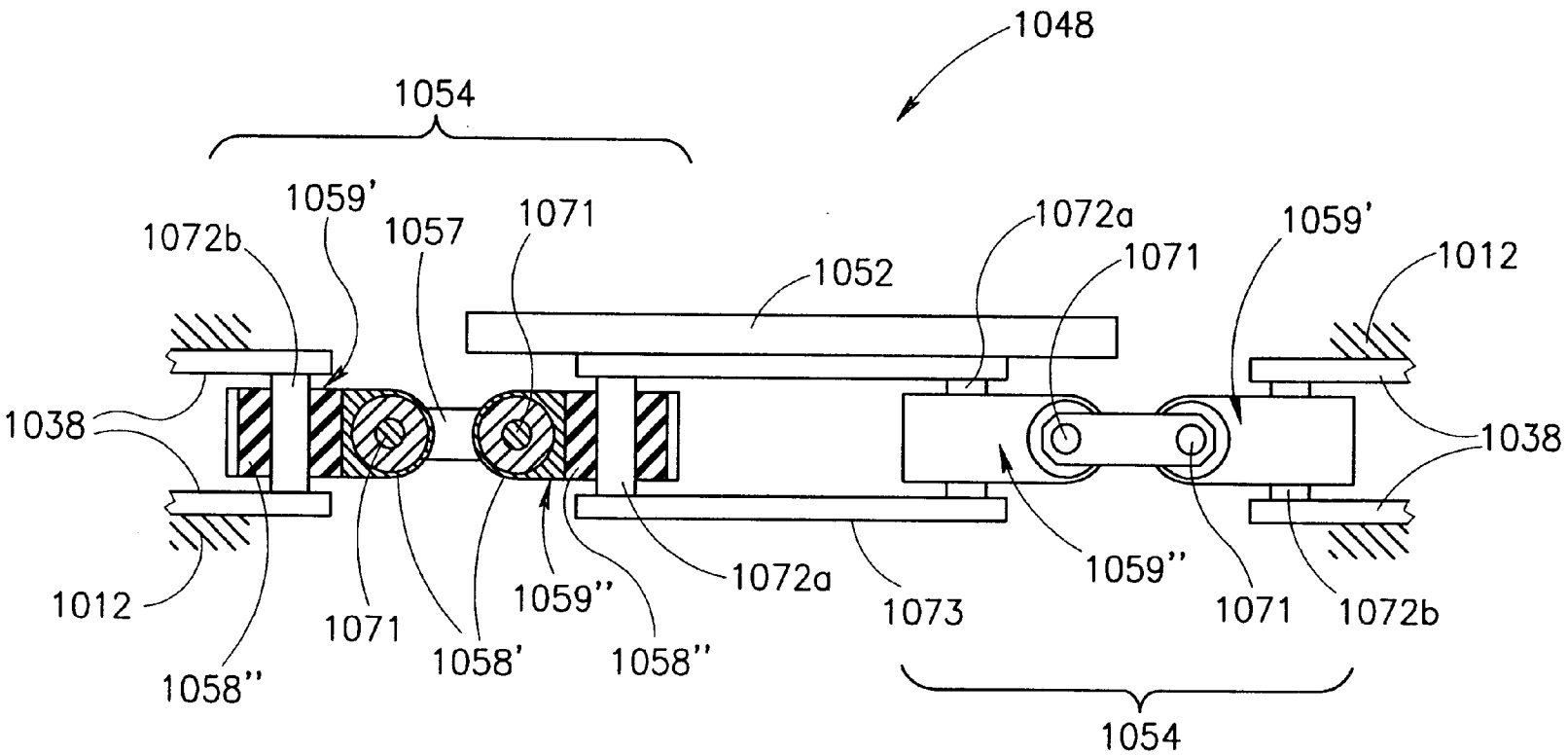
FIG. 5 is a schematic side view, similar to that of FIG. 3, but wherein the illustrated multifrequency converter assembly is seen to employ as resilient attachment apparatus a pair of elastomer bushes having mutually perpendicular orientations.

Referring now to FIG. 5, there is seen multifrequency converter apparatus 1048, which is generally similar to multifrequency converter apparatus 48, shown and described above in conjunction with FIG. 3A, but with certain modifications, as shown and described herein. For purposes of clarity, portions and components of multifrequency converter apparatus 1048 shown and described herein, and having counterpart components and portions shown and described above in conjunction with FIG. 3A, are denoted by similar reference numerals, although with the addition of the prefix "1)," and are not specifically described again herein.

In the present embodiment, actuator 1052 is connected to housing 1012 by means of two resilient mounts 1054, each of which is formed in a chain link arrangement, in which first and second pairs of elastomer bushes, respectively referenced 1059' and 1059", are connected rigidly together.

Each of the first and second pairs 1059' and 1059" has a pair of inner and outer elastomer bushes 1058' and 1058", respectively. Parallel axles 1071 extend through inner bushes 1058', while axles 1072*a* and 1072*b*, which are perpendicular to axles 1071, extend through outer bushes 1058". Each pair of inner bushes 1058' is connected to each other, via axles 1071, by means of a rigid connector element 1057.

The outer bushes 1058" are connected via their respective first and second axles 1072*a* and 1072*b* to actuator 1052 and housing 1012, as follows:

First axles 1072*a* are fastened to actuator 1052 via a suitable, rigid plate construction, referenced generally 1073; and second axles 1072*b* are fastened to housing 1012 via pairs of flanges 1038. The inner sleeves of elastomer bush 1058'" of the pairs 59" are fastened to actuator 1052.

The provision of second axle 1072*a* and 1072*b* transversely, and preferably at right angles, as shown, with respect to first axles 1071, provides a significant "two-dimensional" dynamic boosting, i.e. in two mutually orthogonal directions, of the oscillation of actuator 1052, thereby to increase the velocity of the material being screened.

Figure 6:
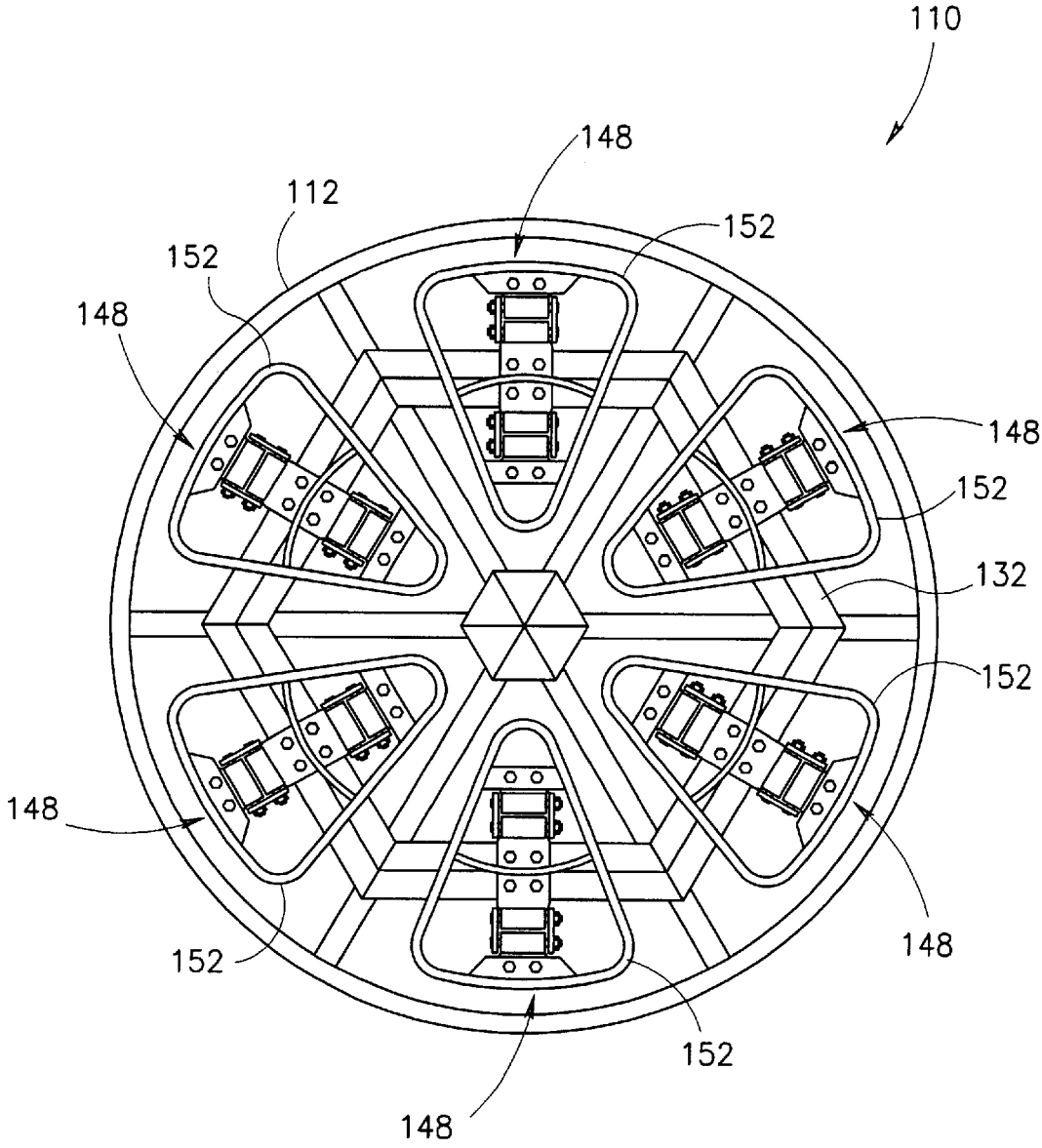
FIG. 6 is a schematic plan view of a tumbler separator having mounted therein the multifrequency adapter system of the present invention, wherein the interface apparatus thereof is formed of a plurality of generally elongate members.

Referring now to FIG. 6, there is shown a vibratory tumbler separator, generally referenced 110, constructed in accordance with a further alternative embodiment of the invention. It will be noted that portions and components of separator 110 which have similar counterpart portions and components of separator 10, shown and described in conjunction with separator 10 of FIGS. 1–3B above; may be denoted by similar reference numerals, but with the addition of a prefix "1", but are not specifically described again, herein.

Figure 7A:
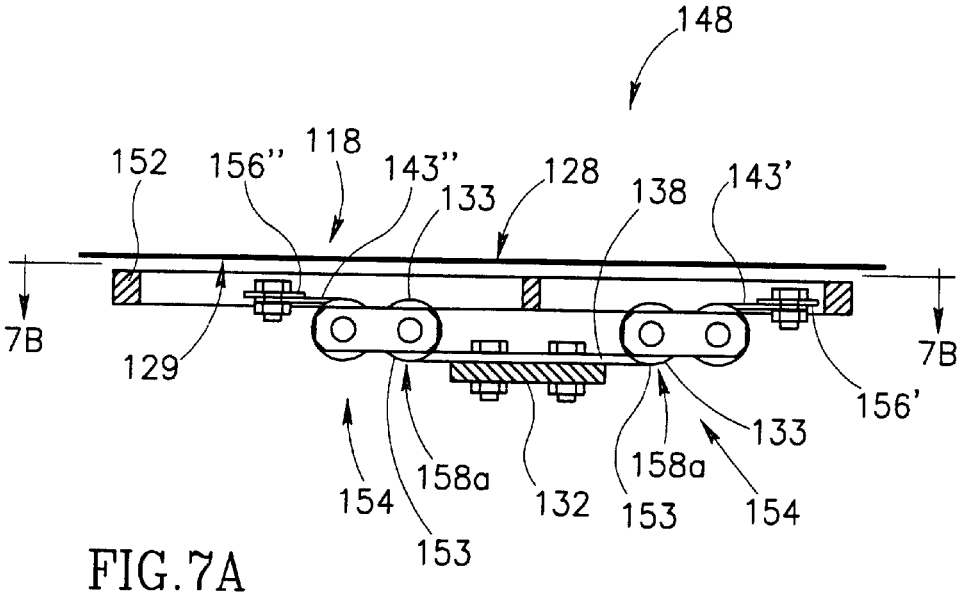
FIG. 7A is an enlarged partial side-sectional view of a portion of the screen assembly and an associated multifrequency converter assembly of the vibratory multifrequency adapter system seen in FIG. 6, taken along line 7A—7A in FIG. 7B.

Separator 110 includes a screen assembly, represented schematically by screen element 128 in FIG. 7A, and a plurality of radially distributed multifrequency converter apparatuses, referenced generally 148, contained within a generally circular housing 112. The multifrequency converter apparatuses 148, shown and described below in detail in conjunction with FIGS. 7A and 7B, may either be formed as an integral part of a separator constructed in accordance with the present invention, or may alternatively be used for retrofitting a conventional separator.

Figure 7B:
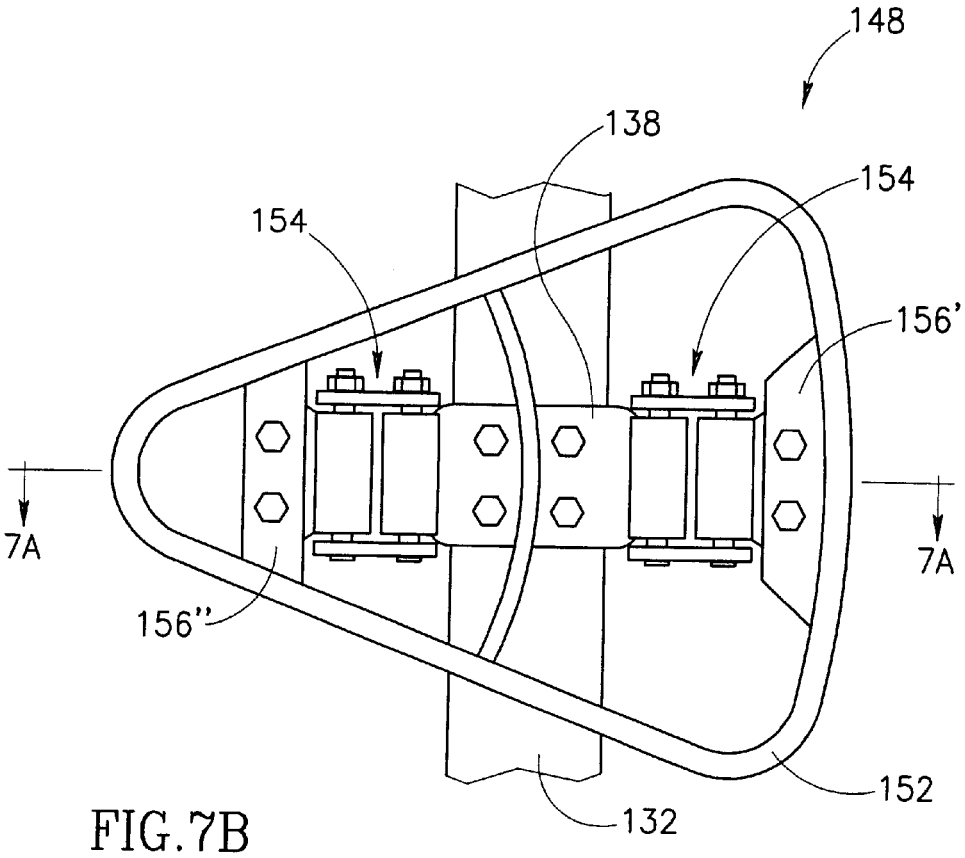
FIG. 7B is a plan view of the portion of the multifrequency adapter system illustrated in FIG. 7A.

As seen in FIG. 7A, screen assembly 118 includes a screen element 128, disposed over and supported by interface apparatus 129. Referring now particularly to FIGS. 7A and 7B, each multifrequency converter apparatus 148 is formed of a rigid actuator 152, and non-linear resilient attachment apparatus formed of resilient mounts 154. Resilient mounts 154 are generally as described above with respect to resilient mounts 54 in conjunction with FIG. 3A, and are thus not specifically described again herein, in detail.

Actuator 152 has first and second connection portions 156' and 156", via which end connectors 143' and 143", respectively, (FIG. 7A) are used to attach actuator 152 to resilient mounts 154. An intermediate support element 138 is operative to fasten the outer sleeves 153 of elastomer bushes 158*a* to the housing 112 via a rigid support flange 132 which, as seen in FIG. 6, preferably has a closed polygonal configuration. The actuators 152 are preferably arranged parallel to the screen assembly 118. The operation of the multifrequency converter apparatuses 148 is generally as described above in conjunction with FIGS. 1–3A and is thus not described specifically herein.

Figure 8:
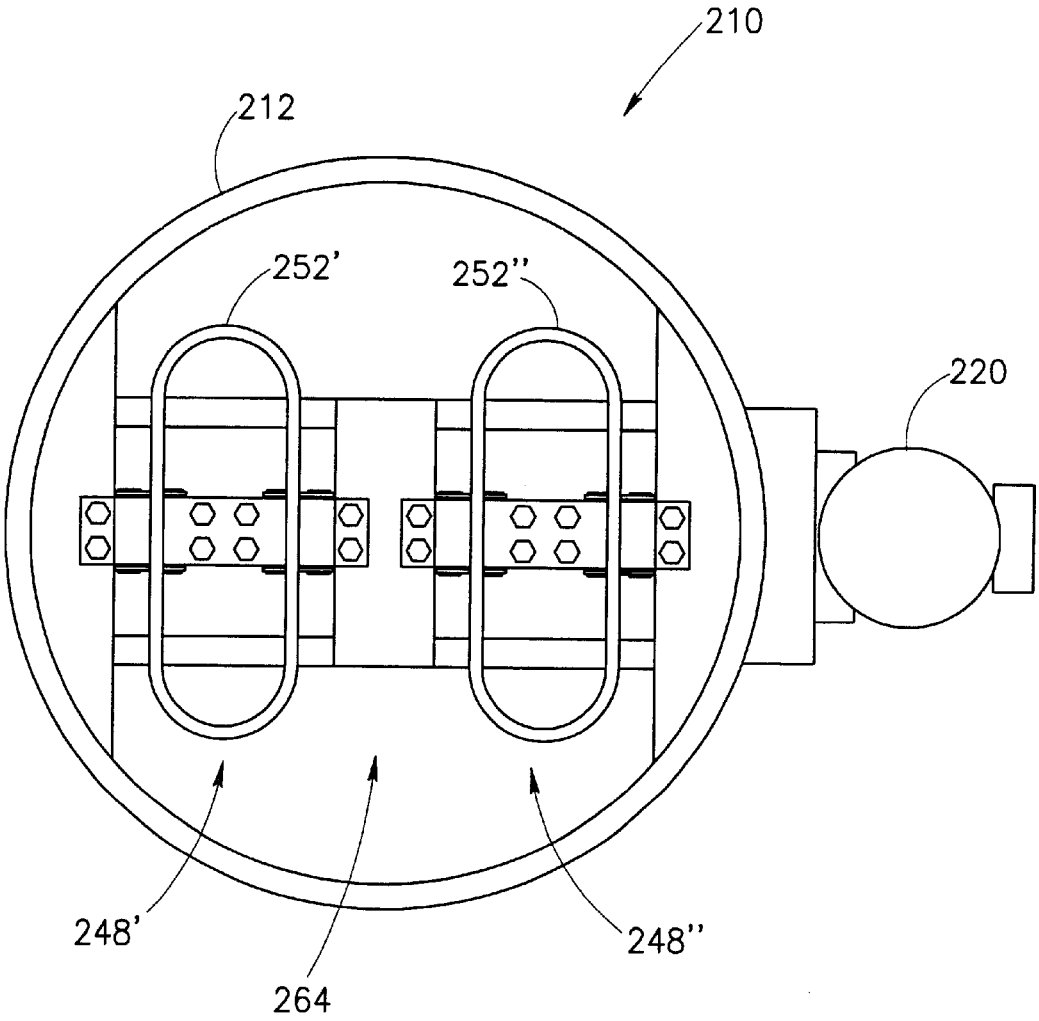
FIG. 8 is a plan view of a circular vibratory separator having a laterally disposed vibrator motor, and employing a multifrequency adapter system constructed in accordance with an additional embodiment of the present invention.
Figure 9:
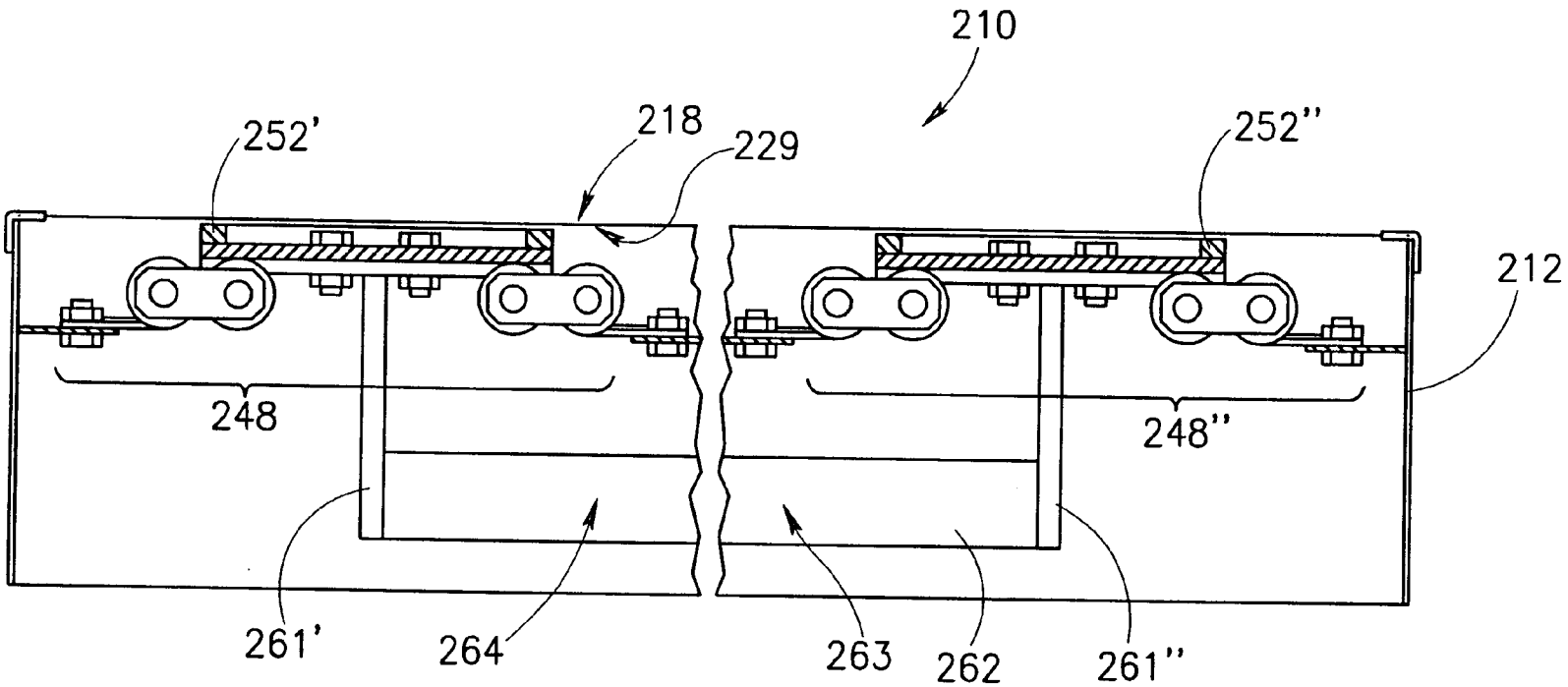
FIG. 9 is a schematic side-sectional view of the screen assembly and the pair of multifrequency converter assemblies illustrated in FIG. 8.

Referring now to FIGS. 8 and 9, there is shown a vibratory separator, referenced generally 210, constructed in accordance with an additional embodiment of the present invention. It will be noted that portions and components of separator 110 which have similar counterpart portions and components of separator 10, shown and described in conjunction with separator 10 of FIGS. 1–3B above, may be denoted by similar reference numerals, but with the addition of a prefix "2", but are not specifically described again, herein.

Separator 210 has a circular housing 212 and is seen to employ a multifrequency adapter assembly 264 (FIG. 9) having a pair of multifrequency converter apparatuses, referenced 248' and 248". Apparatuses 248' and 248" drive respective, generally elliptically-shaped, closed form, rigid actuators 252' and 252", which are rigidly connected together by means of a substantially rigid frame, referenced generally 263 (FIG. 9), which includes frame portions 261', 262 and 261".

A single frequency vibratory motor 220 is mounted laterally with respect to housing 212. When vibratory motor 220 is operated, the frame 263 undergoes a rotational oscillation relative to housing 212, so as to force actuators 252' and 252" to impact the support sieve element 229 of the screen assembly 218, alternately. Frame 263 has a predetermined eccentricity which, it will be appreciated, generates an alternating vibration moment, thus providing to actuators 252' and 252" significant kinetic energy, which further is transferred to sieve assembly 218, thereby to provide desired self-cleaning thereof, and de-agglomeration of material passing therethrough.

Figure 10A:
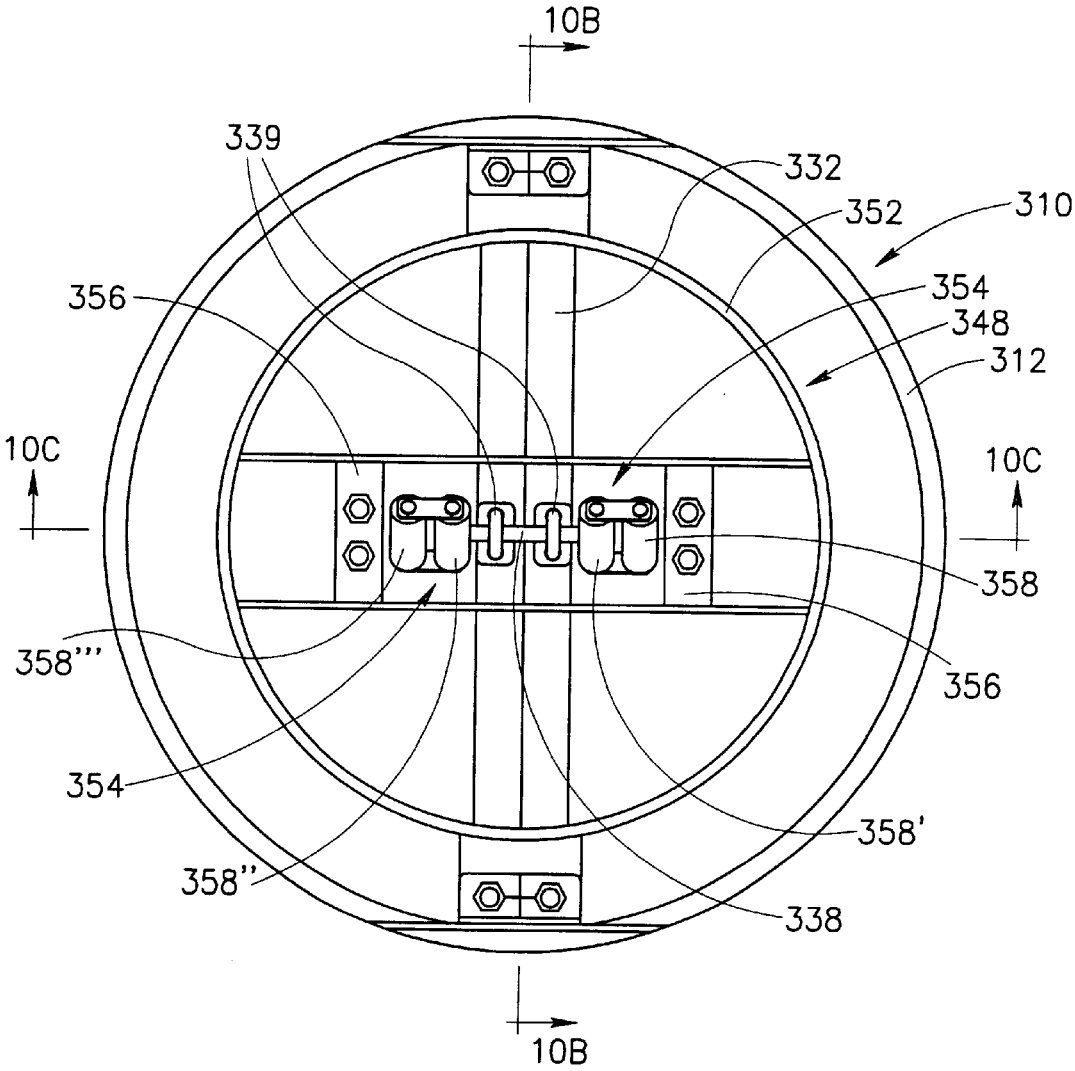
FIG. 10A is a plan view of a tumbler separator employing an adjustable multifrequency adapter system constructed and operative in accordance with yet a further embodiment of the present invention.
Figure 10B:
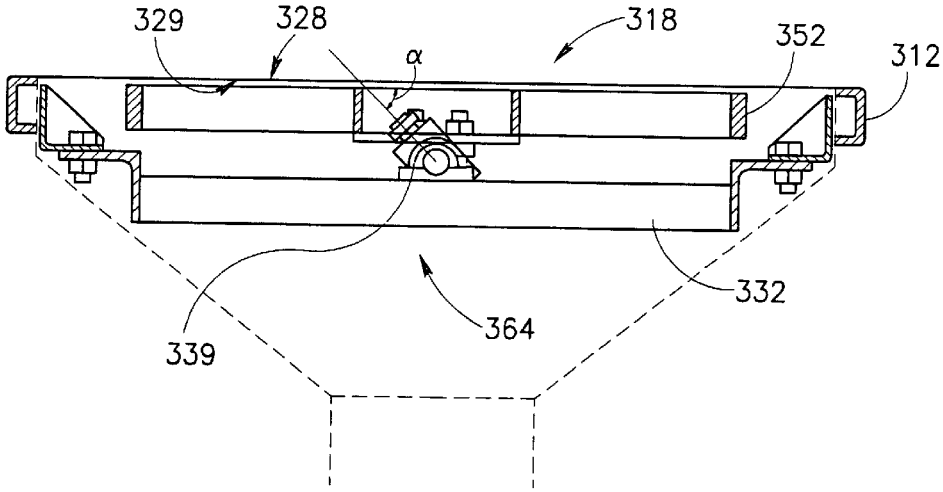
FIG. 10B is a cross-sectional side view of the separator of FIG. 10A, taken along line 10B—10B therein.
Figure 10C:
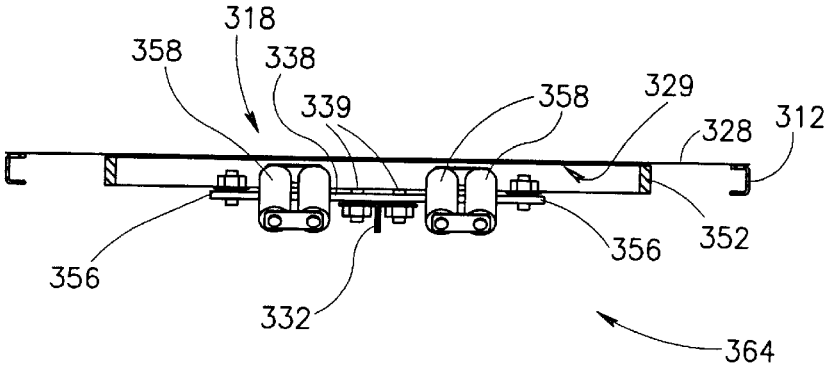
FIG. 10C is a schematic side-sectional view of the apparatus seen in FIG. 10A, taken along line 10C—10C therein, at right angles to the view of FIG. 10B.

Referring now to FIGS. 10A–10C, there is illustrated a tumbler vibratory separator, referenced generally 310, in which there is seen a multifrequency adapter system, referenced generally 364, constructed in accordance with a further alternative embodiment of the invention. Adapter system 364 may either be used to retrofit an existing tumbler vibratory separator having a single frequency excitation source, or separator 310 may be formed as a multi frequency separator, including system 364 at the outset. It will be noted that portions and components of separator 310 which have similar counterpart portions and components of separator 10, shown and described in conjunction with separator 10 of FIGS. 1–3B above, may be denoted by similar reference numerals, but with the addition of a prefix "3", but are not specifically described again, herein.

System 364 is seen to include screen assembly 318 having a screen element 328, interface apparatus 329, and one or more multifrequency converter apparatuses, referenced generally 348, connected to housing 312. Interface apparatus 329 is connected to housing 312 via a peripheral elastic element (not shown). These elements are similar to those shown and described above in conjunction with FIGS. 1–3 and are thus neither shown in detail nor described again herein.

The illustrated multifrequency converter apparatus 348 is formed of a rigid, hoop-shaped actuator 352, having two connection portions 356 for rigid connection thereto of resilient mounts 354 via U-bolts 339 (FIGS. 10A and 10C). A support element 338 (FIG. 10C) fastens the outer sleeves (shown in FIG. 3A at 53) of elastomer bushes 358 to the housing portion 312 via rigid support 332 and U-bolts 339. Convenient loosening and refastening of the described U-bolt connection enables the inclination of the elastomer bushes 358 to be adjusted with respect to the plane of the actuator 352 and interface apparatus 329. The angle of inclination of the bushes 358, denoted $\alpha$ in FIG. 10B, is in the range 0–90 degrees. Accordingly, the excitation of housing 312 and support element 332, which, as described above, is parallel to sieve element 328, is transformed into an inclined vibratory motion of the actuator 352 relative to the sieve assembly 318.

It will be appreciated that the embodiment shown and described above in conjunction with FIGS. 10A–10C realizes a separation method which uses a sequences of shock pulses which are directed at an acute angle to the sieve surface, thus facilitating extraction of particles lodged in the sieve opening. It will be also appreciated that the particular construction shown and described above in conjunction with FIGS. 10A—10C, is by way of example only, and that the present invention includes any construction which enables screening in accordance with the above-described method.

Figure 11A:
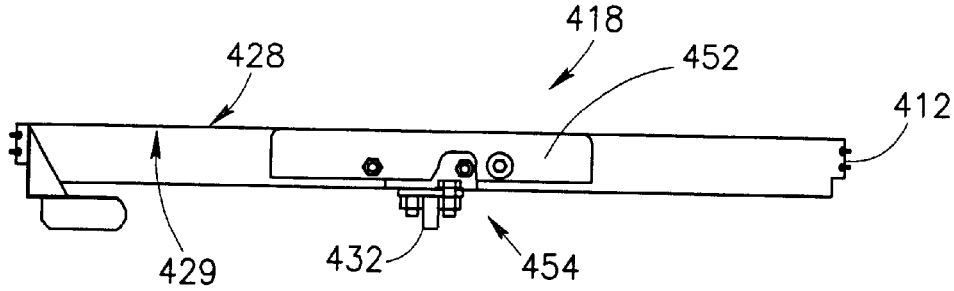
FIG. 11A is a cross-sectional view, taken along line 11A—11A of FIG. 11B, of a tumbler vibratory separator having an axially aligned vibratory motor, employing a multifrequency adapter system constructed and operative in accordance with an additional embodiment of the present invention.
Figure 11B:
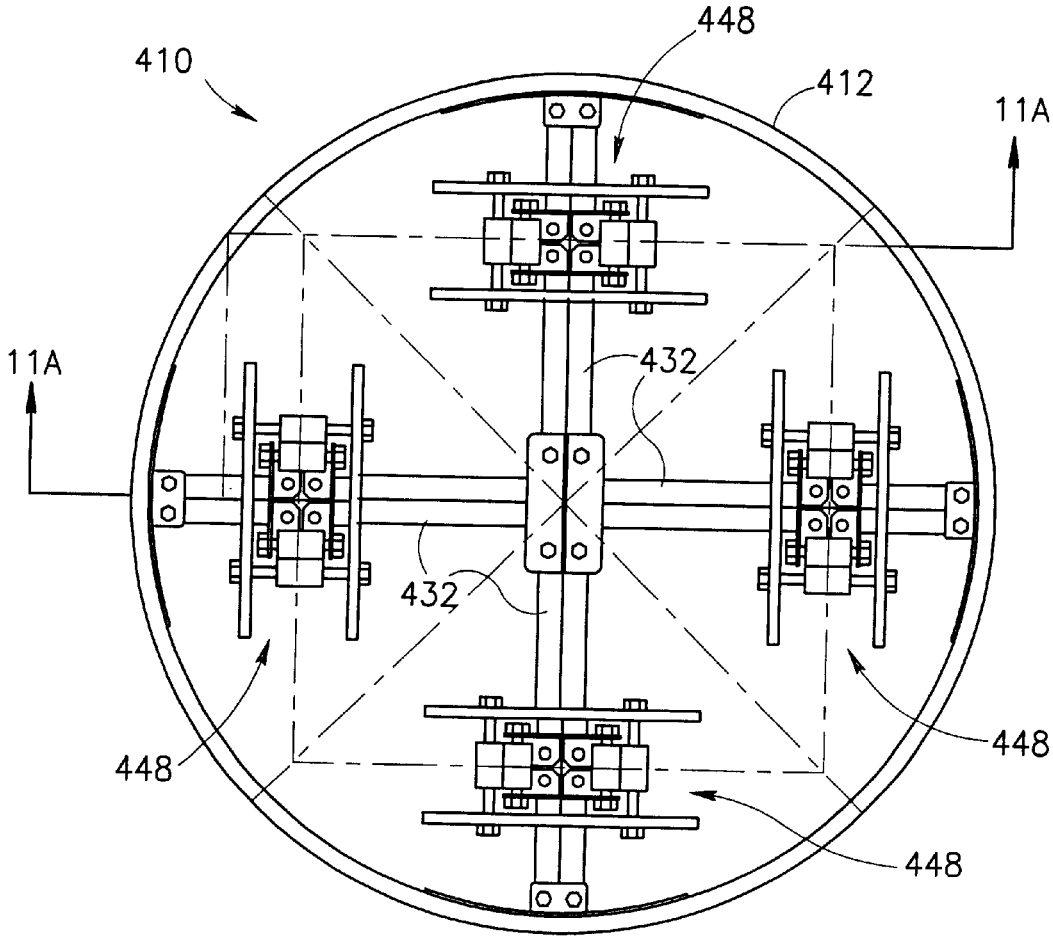
FIG. 11B is a top view of the vibratory separator of 11A.

Referring now to FIGS. 11A and 11B, there is shown a tumbler vibratory separator, referenced generally 410, constructed and operative in accordance with an additional embodiment of the present invention. As with previous separators described above, separator 410 may have the adapter system of the invention formed integrally therewith, or it may be an existing vibratory separator which has been retrofitted with the adapter system of the invention.

The adapter system of the present embodiment thus includes, in conjunction with screen assembly 418, interface apparatus 429, and a plurality of multifrequency converter apparatuses 448, mounted in housing 412, via support members 432. These components are generally similar to their counterpart components shown and described above in conjunction with FIGS. 1–7B, and are thus neither specifically shown in detail in the drawings, nor described again herein. Components having counterpart components in any of the above-referenced drawings, are designated with similar reference numerals herein, but bearing a "4" prefix.

Figure 12A:
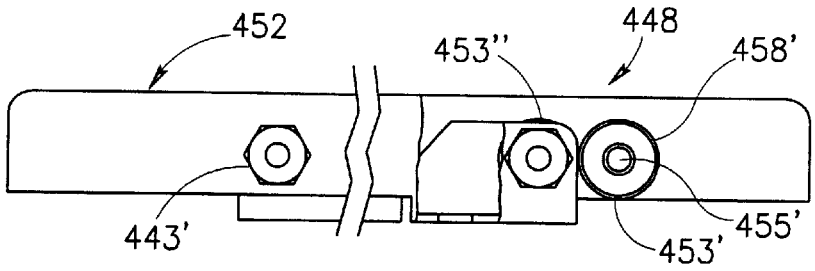
FIG. 12A is a partially cut away, enlarged side view of multifrequency converter assembly of the multifrequency adapter system seen in FIGS. 11A and 11B.
Figure 12B:
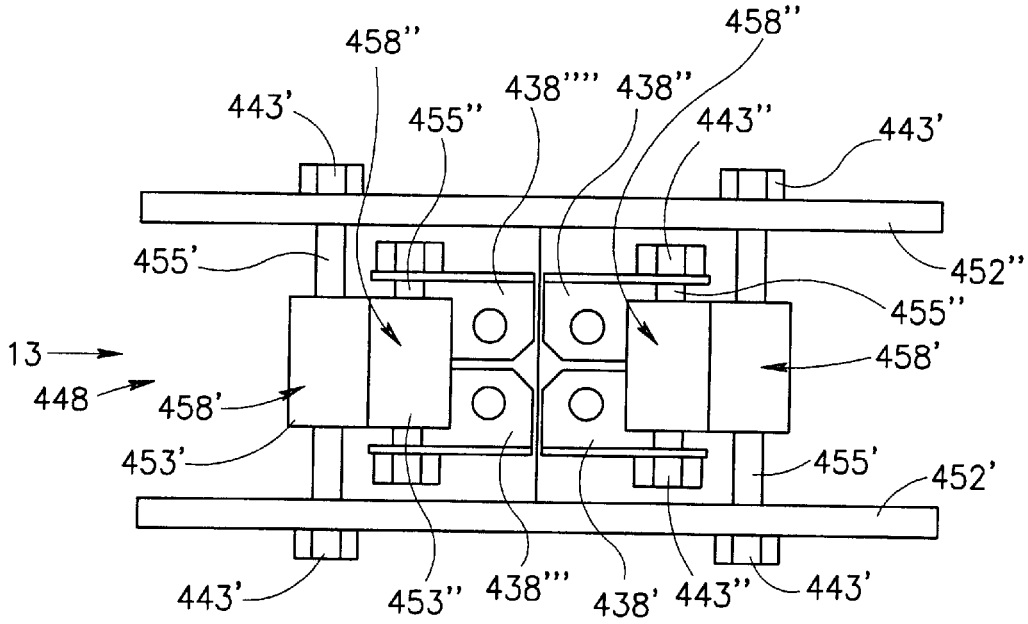
FIG. 12B is an enlarged plan view of the multifrequency converter assembly seen in FIG. 12A.

Referring now to FIGS. 12A and 12B, it is seen that, in the embodiment shown and described above in conjunction with FIGS. 11A and 11B, each multifrequency converter apparatus 448 has a rigid actuator, referenced generally 452, and resilient mounting apparatus, referenced generally 454.

As seen in FIG. 12B, rigid actuator 452 has first and second actuator portions, respectively referenced 452' and 452", which are suitably connected, by means of bolted connections 443', to axles 455' of elastomer bushes 458', thereby to lock the actuator portions in a predetermined mutual positioning. The outer sleeves 453' and 453" of elastomer bushes 458' and 458" are connected to each other in any suitable manner, such as by welding, so as to have a predetermined axis-to-axis distance. A plurality of support elements 438', 438", 438'" and 438"" is used for connection of the multifrequency converter apparatus 448 to the housing 412 (FIGS. 11A and 11B). Of these support elements, the elements 438' and 438" are connected to axles 455' by means of bolted connections 443", thereto, and support elements 438'" and 438"" are also mounted in a similar manner.

Referring now again to FIGS. 11A and 11B, rigid actuators 452 are typically arranged parallel to the screen assembly 418, so as to impact the distributing support assembly, when in operation, and thus further providing multifrequency excitation of the screen element. The operation of the multifrequency converter apparatuses 448 is generally as described above in conjunction with the embodiments of FIGS. 1–7B and is thus not described specifically herein.

Figure 12C:
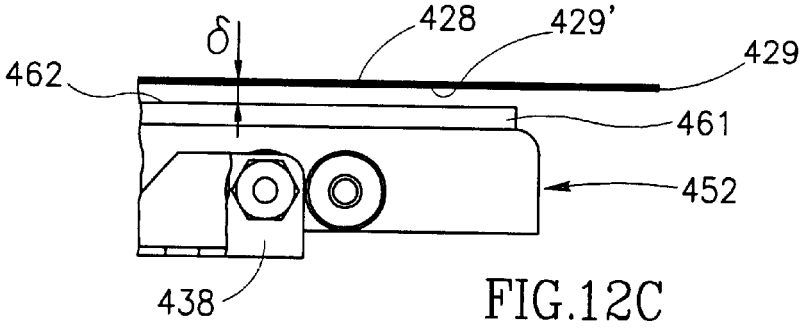
FIG. 12C is a schematic partial cross section side view of multifrequency converter assembly as seen in FIG. 12A, but also including a buffer element attached to an impacting surface of the actuator element thereof, in spaced relation with the illustrated interface element.

Referring now to FIG. 12C, it is seen that, in accordance with one embodiment of the present invention, a buffer element or lining pad 461 of a low wear material such as polyurethane rubber or the like, is fastened to the rigid actuator 452, so as to provide a predetermined gap δ between the actuator contact surface 462 and the impacted surface 429' of interface apparatus 429. The thickness and material parameters of lining pad 461, and of the gap δ, are predetermined so as to provide a predetermined shock pulse duration, and a desired spectrum density of multifrequency vibration of the screen element 428. The gap is preferably adjustable by means of placement of washers between support elements 438 and an associated housing portion (not shown).

Figure 12D:
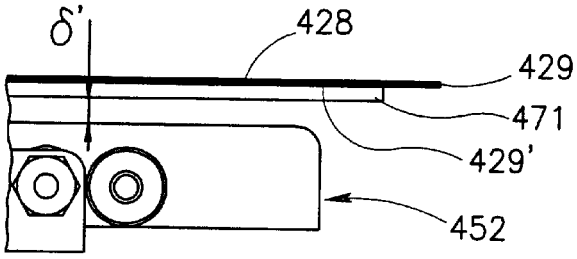
FIG. 12D is a view similar to that of FIG. 12C, but wherein a lining cover is attached to the illustrated interface element.

Referring now to FIG. 12D, in accordance with a further embodiment, a buffer element or lining cover 471 is seen to be provided on the impact surface 429' of the support element 429, supporting the screen element 428. The lining cover 471 is similar to pad 461 (FIG. 12C). The thickness and material parameters of lining pad 471, and of the gap δ', are predetermined so as to provide a predetermined shock pulse duration and spectrum density, giving rise to an efficient system, and substantially uninterrupted self-cleaning of the screen element 128. When agglomerated powder material is screened on a coarse sieve, the lining cover 471 may be directly fastened to the bottom of the coarse sieve. In this case lining cover portion 471 distributes impact loads applied thereto by actuators 452, while providing mechanical protection to screen element 128.

Figure 13:
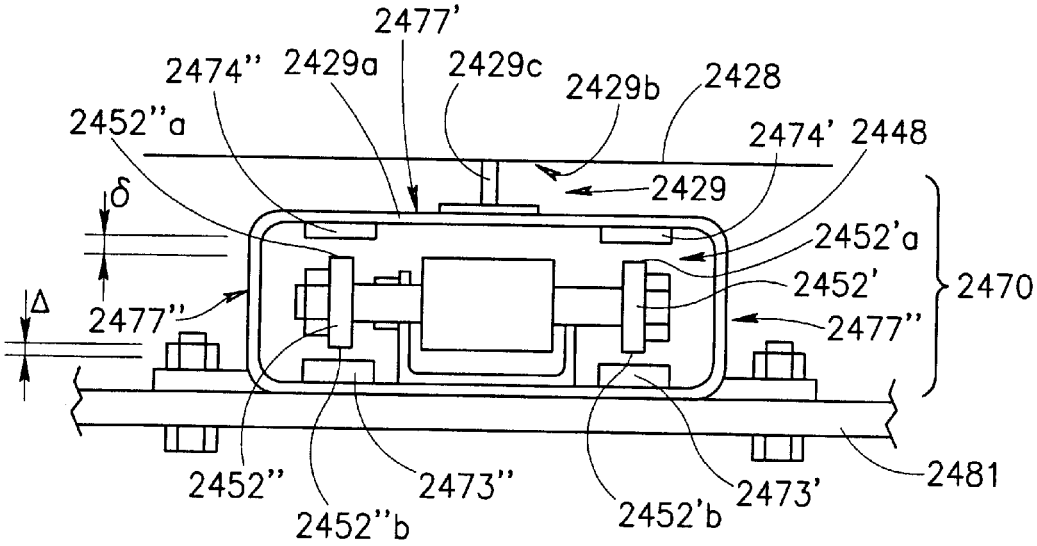
FIG. 13 is a schematic side view of an integrated multifrequency adapter system for use in a vibratory separator, constructed and operative in accordance with yet a further embodiment of the present invention.

Referring now to FIG. 13, there is shown an integrated multifrequency adapter system, referenced generally 2470, constructed in accordance with a further alternative embodiment of the invention. As with the above-described embodiments of the invention, system 2470 may be formed integrally with a multifrequency vibratory separator in accordance with one embodiment of the invention, or it may be used to retrofit an existing vibratory separator, in accordance with an alternative embodiment of the invention.

System 2470 includes an integrated multifrequency converter assembly, referenced generally 2448 which is similar to multifrequency converter assembly 448 shown and described above in conjunction with FIGS. 12A–12B. It will be appreciated that multifrequency converter assembly 2448 is essentially the multifrequency converter assembly 448 depicted in FIG. 12B; the view of FIG. 13 being a side view of the assembly seen in FIG. 12B, as seen in the direction depicted by arrow 13 therein.

In the present embodiment, however, interface apparatus 2429 is formed as a casing 2429*a* which encloses assembly 2448, a generally planar support element 2429*b* juxtaposed to and underneath screen element 2428, and an intermediate stem portion 2429*c* which rigidly connects support element 2429*b* to casing 2429*a*. Casing 2429*a* is further connected to a portion of the housing (not shown) via a connector plate 2481.

Casing 2429*a* further has provided on inward-facing surfaces thereof a pair of lower buffer elements or pads 2473' and 2473"; and a pair of upper buffer elements or pads 2474' and 2474", wherein lower and upper pads 2473' and 2474' are arranged to receive impacts of actuator portion 2452', lower and upper pads 2473" and 2474" are arranged to receive impacts of actuator portion 2452".

Respective predetermined upper and lower gaps, respectively referenced δ and Δ, are provided between the upper pads 2474' and 2474", and the lower pads 2473' and 2473"; and the associated actuator impact surfaces 2452'*a* and 2452"a, and 2452'*b* and 2452"b, of actuator portions 2452' and 2452". It will be appreciated that gaps δ and Δ may be preset during assembly, in accordance with a required spectrum density.

While casing 2429*a* functions as a portion of the interface apparatus, an upper portion thereof only, referenced 2477', may be provided with a required rigidity, in order to properly transmit excitation from multifrequency converter apparatus 2448, while side portions thereof, referenced 2477", may be formed so as to be less rigid and more elastic, thereby essentially functioning as elastic links between the interface apparatus and the connector plate 2481.

The material, shape and other parameters of support element 2481 are selected so as to properly transmit excitation from the separator housing (not shown) to the multifrequency converter assembly 2448, but so also as to reduce the transmission of high frequency acceleration from assembly 2448 to the separator housing, which might otherwise induce metal fatigue therein.

A particular advantage of multifrequency converter assembly 2448, as shown and described above, is that it can be manufactured as a fully self-contained, ready-made product, in which the gaps, too, are preset, so as to enable relatively quick and convenient on-site assembly with an existing vibratory separator.

When the vibratory separator is operated, the casing 2429*a* of integrated multifrequency converter assembly 2448 is excited due to vibration of the separator housing (not shown) via the support element 481. Consequently, actuator portions 2452' and 2452" vibrate in a "dynamic boosting" or "near resonant boosting" mode on resilient mounts (not shown), relative to casing 2429*a*, such that the rigid actuator portions 2452' and 2452" strike inward-facing surfaces of casing 2429*a* via the elastic buffer pads 2473', 2473", 2474' and 2474". Unilateral or bilateral mechanical shock pulses are transmitted to casing 2429*a* and to the intermediate portion 2429*c* of the interface apparatus, which is pressed against lower surface 2429*b* of the screen assembly, thus transferring thereto a predetermined multifrequency vibration, so as to prevent clogging of sieve 2428 and providing efficient screening of difficult-to-screen materials.

Referring now to FIG. 14A–14D, there is shown a further alternative construction of an integrated multifrequency converter assembly or unit, referenced generally 3448, formed as a hermetically sealed box. Multifrequency converter assembly 3448 has a casing 3429*a* which surrounds the rigid actuator, referenced generally 3452, and resilient mounting means, generally 3454. In order to prevent the entry of dust and powder into casing 3429*a*, it is hermetically closed by side covers 3477' and 3477" fastened as by threaded connectors 3479 and 3487. The casing 3429*a* has a threaded pin portion 3429*c* for connection to a support (not shown), which may be any suitable interface element, generally as shown and described above in conjunction with FIG. 13, or as shown and described hereinbelow in conjunction with any of FIGS. 15–22D.

The rigid actuator 3452 has a generally prismatic shape, and has an upper portion 3452', a bottom portion 3452", and side portions 3452'" and 3452"", as well as an additional weight 3486. The actuator portions 3452'–3452"" and additional weight 3486 are connected together under compression by bolted connections 3485 and 3443'.

Resilient mounting apparatus 3454 preferably includes two pairs of elastomer bushes 3458' and 3458" (FIGS. 14B and 14D), having respective interconnected outer sleeves 3453' and 3453". Elastic bushes 3458' also have inner axles 3455', which are connected to casing 3429*a* by means of compressing bolt connection 443'. Inner sleeves 455" of elastic bushes 3458" are connected to side portions 3452'" and 3452"" by means of compression bolted connection 3443". A protective elastomeric buffer pad 3461 is provided in association with an upward-facing surface of upper actuator portion 3452'. Similarly, a long-wearing elastomeric buffer pad 3462 is preferably provided in association with a downward-facing surface of additional weight 3486. It will be appreciated that, in the presently illustrated construction, in which the structure is generally symmetrical about the longitudinal axis L of threaded pin portion 3478, this axis also serves as a force transfer axis. The interaction of the various components of the illustrated apparatus is substantially as described above in conjunction with FIG. 13 and is thus not described again herein. The functions of buffer pads 3461 and 3462 are substantially as described above in conjunction with the embodiment of FIGS. 1–3B above, and are thus not described again herein.

In the event that the multifrequency converter apparatus is to be used in the presence of intense side translation vibration, which is characteristic of tumbler vibratory separators, for example, additional transversal impact excitation may be provided for intensification of particle separation, if elastic relative transverse motion of rigid actuator means 3452 relative to the casing 3477 is used. Predetermined phase relationships may be obtained by preselection of the side gaps $\delta_3$ and $\delta_4$ seen in FIG. 14B, and of the parameters of the elastomer protecting pads between rigid actuator 3452 and the inward-facing surface of casing 3477.

Figure 14A:
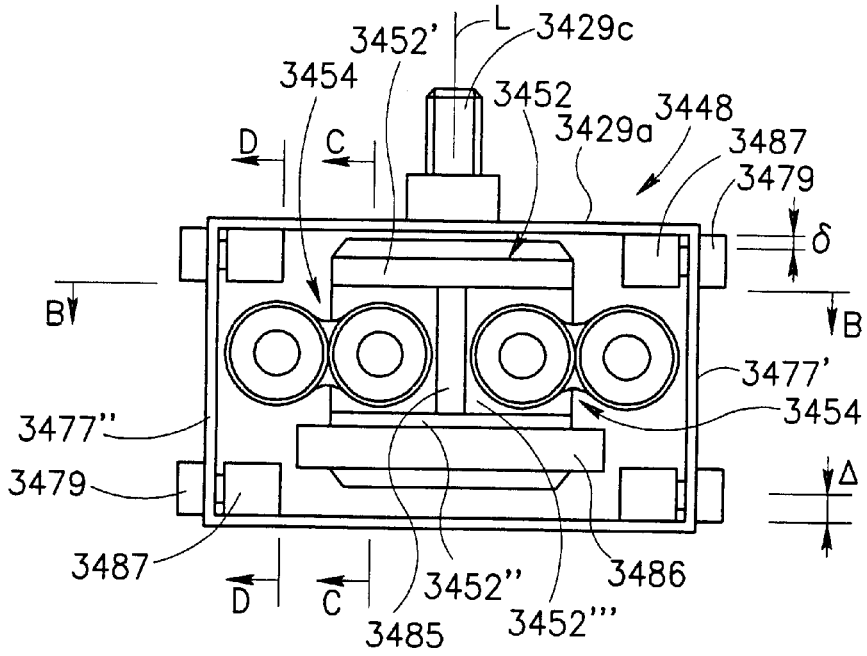
FIG. 14A is a cross-sectional side view of a modification of the integrated multifrequency adapter system of FIG. 13.
Figure 14B:
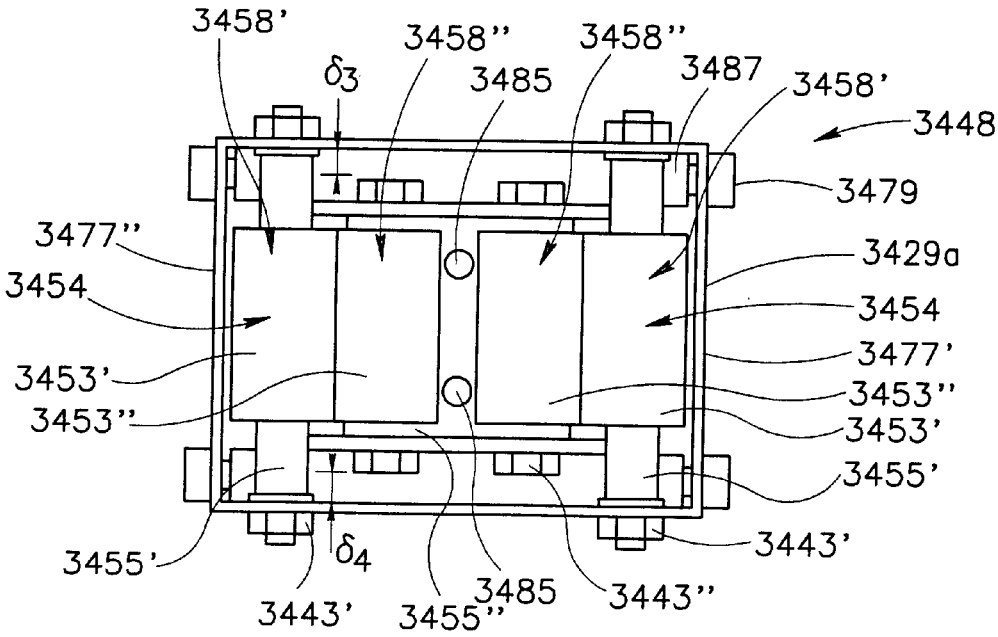
FIGS. 14B–14D are various cross-sectional views of the multifrequency adapter system seen in FIG. 14A, taken along lines B—B, C—C, and D—D, respectively.
Figure 14C:
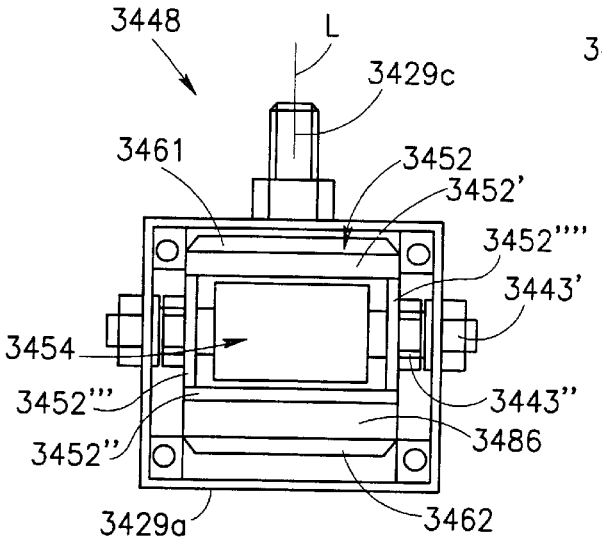
Figure 14D:
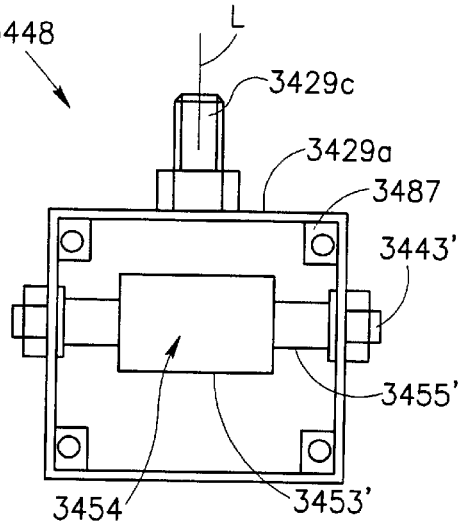
Figure 14E:
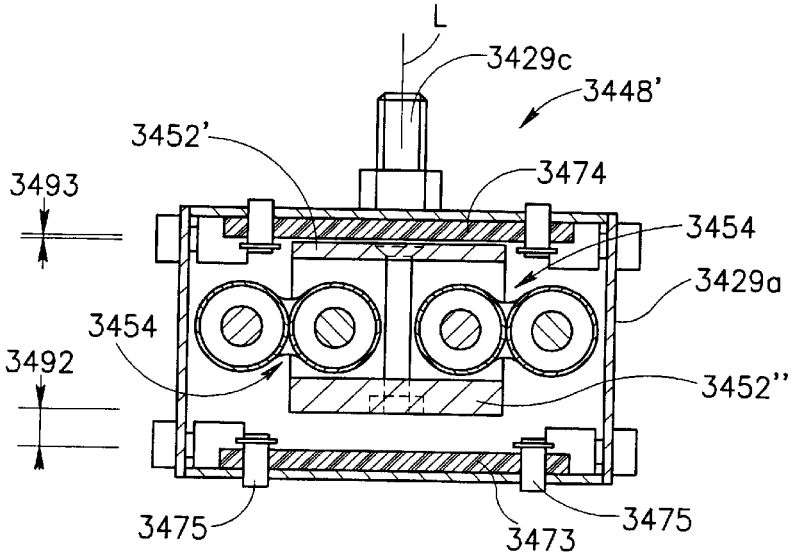
FIG. 14E is a cross-sectional view of a further variation of the multifrequency adapter system seen in FIGS. 13–14D, employing an internal elastomer housing lining.

Referring now to FIG. 14E, there is shown a further alternative embodiment of an integrated multifrequency converter unit, referenced generally 3448'. Unit 3448' is similar to unit 3448, shown and described above in conjunction with FIGS. 14A–14D, except for the addition of a lower elastomer lining or buffer pad 3473 between lower actuator portion 3452" and casing 3429*a*; and an upper elastomer lining or buffer pad 3474 between upper actuator portion 3452' and casing 3429*a*. Both pads are located, as seen, at areas of contact between actuator 3452 and casing 3429*a*, defining lower and upper gaps, respectively referenced 3492 and 3493. Pads 3473 and 3474 are secured to casing 3429*a* as by fasteners 3475. Alternatively, pads 3473 and 3474 may be merely positioned between the various actuator portions and casing 3429*a*, rather than being fastened thereto, such that they 'float'. Operation of unit 3448 is similar to that described above in conjunction with FIGS. 13, and 14A–D and is thus not described again herein.

Figure 15:
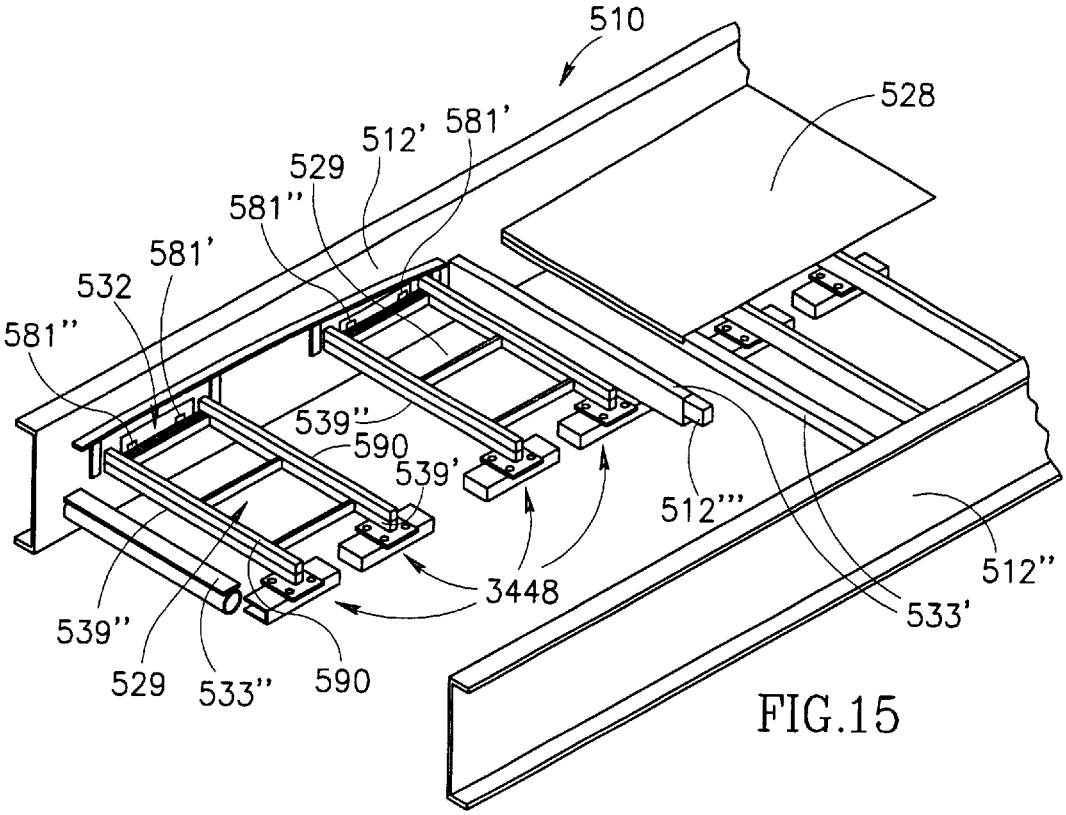
FIG. 15 is a perspective, partially cut-away view of a rectangular screen separator employing a multifrequency adapter system in accordance with a further embodiment of the present invention.

Referring now to FIG. 15, there is shown, in accordance with a further alternative embodiment of the invention, a multi-deck vibratory screen separator, referenced generally 510, particularly useful for the controlled screening of materials that are stick, wet or are otherwise difficult to screen. Separator 510 is seen to have a plurality of decks, each having a rectangular sieve element, and is driven by an unbalanced vibrator (not shown). In more detail, separator 510 includes sieve elements 528 (of which a portion of a single one only, is illustrated) which are activated in a combined vibration mode. In each deck, a sieve element 528 is stretched across sieve guide portions 532, fixedly attached to housing side portions 512' and 512" joined by crossbeams 512'" (seen in a broken view in FIG. 15,) by tensioning elements 533' and 533". The arrangement thus described is essentially known in the art, and functions as a single frequency vibratory separator.

In accordance with an embodiment of the present invention, plural multifrequency converter units 3448 are attached to tappet distributing assemblies associated with each deck, which function herein as interface arrangements 529. Multifrequency converter units 3448 are as shown and described above in conjunction with FIGS. 14A–14E, and are thus not described again herein, in detail. Interface arrangements 529 are resiliently connected to sides 512' and 512" by means of elastic elements 581 ' and 581", and which serve to mount tappet portions 539' and 539" having lining elements 590 in pre-stressed contact with the lower surface of sieve elements 528. Lining elements 590 may be formed in any suitable manner, typically of profiled wear-proof elastomer, preferably, polyurethane or the like.

Elastic elements 581' and 581" are of any suitable type that permits a suitable excitation to be set up at interface arrangements 529, and which serve to isolate housing 512 from undesirable vibrations. In particular, elastic elements 581' and 581" may be formed as suitable metal or composite leaf springs, rubber or rubber-bond-to-metal mounts, elastomer bushes, and the like.

When separator 510 is activated, each sieve element 528 is caused to vibrate. A single frequency component is supplied through the edges of each sieve element 528 by the vibrator at its forced frequency, typically between 15 and 30Hz. This vibration is transferred to the screen element 528 via the vibratable housing 512, sieve guide portions 532, and tensioning elements 533' and 533". Multifrequency vibrations are generated by multifrequency converter apparatuses 3448, substantially as described above in conjunction with FIGS. 14A–14E. Preferably, each deck combination of a sieve element 528, multifrequency converter apparatus 3448, and interface apparatus, has excitation parameters different from excitation parameters of one or more of the other of the deck combinations.

Each multifrequency converter unit 3448 is subjected to a translational vibration of the housing 512 and transfers multifrequency vibrations along a lower surface of the sieve elements 528 via tapping portions 539' and 539", and via linings 590 of the interface arrangements 529. The parameters of the elastic elements 581' and 581", the interface arrangements 529, the multifrequency converter units 3448, and the amplitude and frequency of vibratory excitation of the housing 512, are preselected to optimally separate difficult-to-screen materials. This is particularly suitable for heavy duty screens intended for screening wet and sticky materials, such as, gravel, sand and clay, as it has a high capacity and, using the present invention, blinding of the screen elements 528 is prevented.

Figure 16:
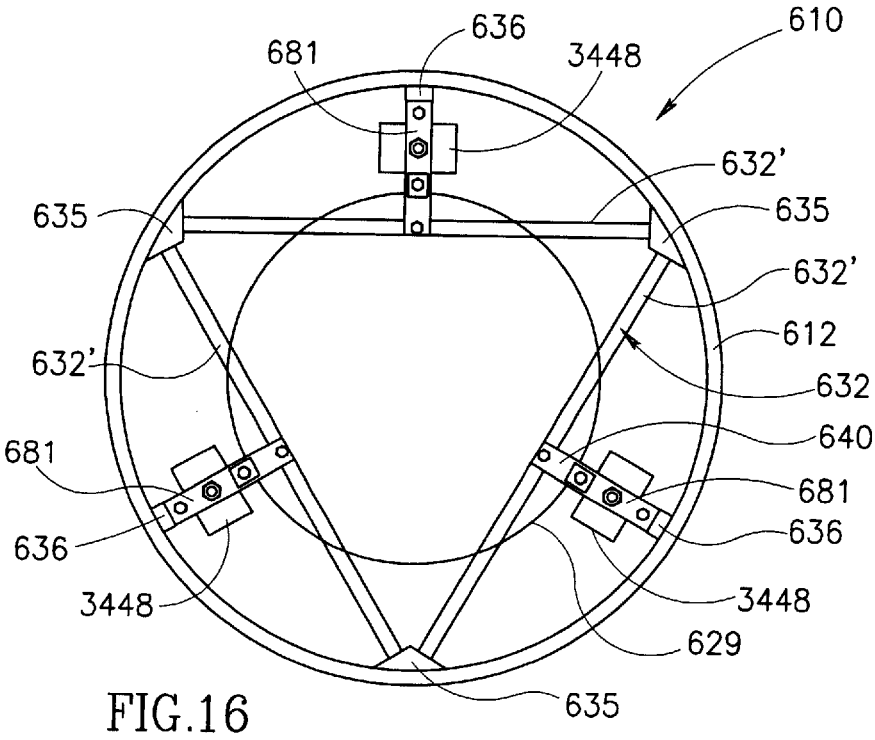
FIG. 16 is a plan view of a vibratory separator for the screening of fine powders, employing a multifrequency adapter system of the present invention.

Referring now to FIG. 16, there is shown in schematic plan view, a vibratory separator, referenced generally 610, for the screening of fine powders, referenced generally 610, employing a multifrequency adapter system of the present invention. Ring-shaped housing portion 612 has affixed thereto a plurality of first support brackets 635, which combine to support a support framework 632; and a plurality of second support brackets 636. Resilient support elements 681 are attached between each second bracket and beam portions 632', which combine to form support framework 632. A single multifrequency converter unit 3448, as shown and described above in conjunction with FIGS. 14A–14E, is attached to each of the elastic support elements 681. In the present embodiment, the interface apparatus is provided as a ring-shaped interface element 629, which is attached to elastic support elements 681 via a plurality of connecting portions 640.

Interface element 629 is typically covered by an elastomer lining (not shown) on its upward-facing edge which contacts the screen assembly (not shown) and is retained in touching contact with the downward-facing surface thereof. In accordance with one embodiment of the invention, interface element 629 may be bonded to the screen element (not shown) by a suitable cement. Elastic support elements 681 have prescribed bending and axial stiffness characteristics such that, in response to single frequency excitation, such excitation is conducted to units 3448. Multifrequency converter units 3448 are also operative to connect elastic support elements 681 to ring-shaped interface element 629. As element 629 is retained in touching contact with the screen element (not shown), the multifrequency excitation is conducted directly thereto, and thence to material being screened.

Figure 17A:
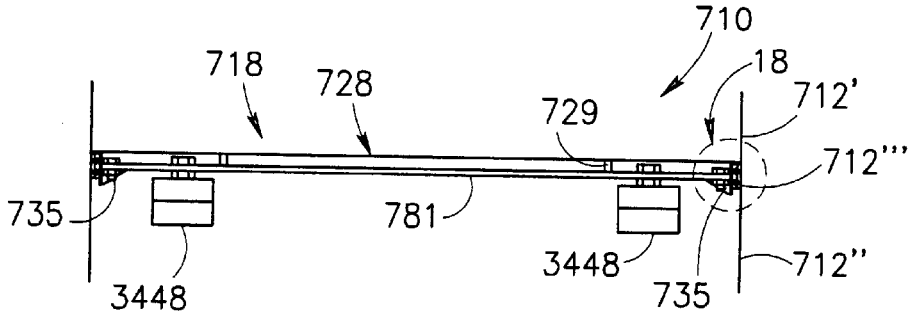
FIG. 17A is a schematic cross-sectional view of the screen assembly of a tumbler separator, employing a multifrequency adapter system of the present invention, taken along line A—A in FIG. 17B, and constructed in accordance with yet a further embodiment of the present invention.
Figure 17B:
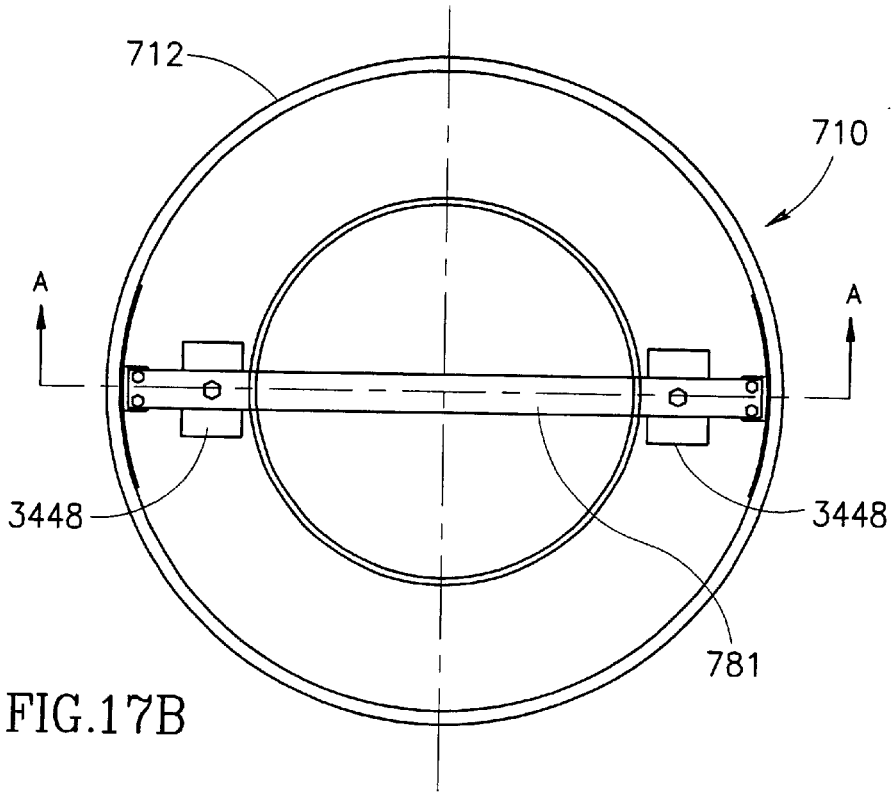
FIG. 17B is a top view of the screen assembly and multifrequency adapter system seen in FIG. 17A.

Referring now to FIGS. 17A and 17B, there is shown, a tumbler vibrator separator, generally referenced 710, constructed in accordance with a further alternative embodiment of the invention. The illustrated separator includes in combination, a screen assembly 718, a pair of multifrequency converter units 3448, as shown and described above in conjunction with FIGS. 14A–14E, and interface apparatus 729, all of which are assembled in a cylindrical housing 712.

Figure 18:
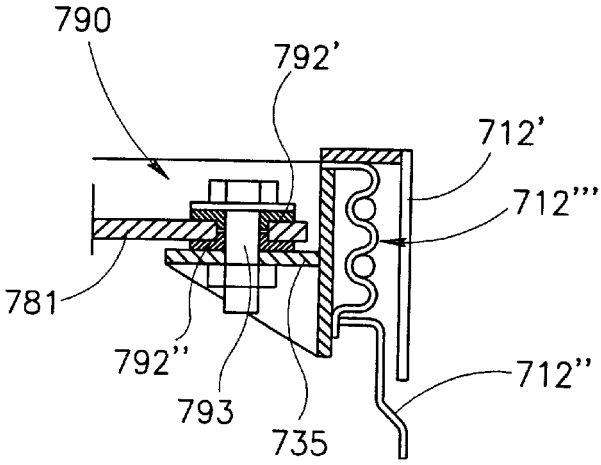
FIG. 18 is a schematic enlarged cross-sectional view of the portion of FIG. 17A denoted 18 in FIG. 17A.

As seen in FIG. 18, a single elastic support element 781, extending diametrically beneath the screen assembly 718, is supported in an intermediate frame portion 712'", disposed between an upper housing portion 712' and a lower housing portion 712". Elastic support element 781 is supported in intermediate frame portion 712'" by means of support brackets 735, via a suitable rigid, typically bolted or welded connection. A preferred type of connection is described in detail in conjunction with FIG. 18, below.

Multifrequency converter units 3448 and interface apparatus, provided herein, as in the embodiment of FIG. 16, by a means of a ring-shaped interface element 729, are both fastened to elastic support element 781, which functions generally as a leaf spring. The term 'leaf spring' is used to imply an element that, under normal operating conditions, is subject to elastic excitation. Ring 729 is preferably maintained in prestressing, touching contact with the screen element 728. The two multifrequency converter units 3448 are arranged diametrically opposite each other, and each receives a single frequency excitation when the single frequency excitation source (not shown) of the separator 710 is activated. As described above, each multifrequency converter unit 3448 is operative to emit a multifrequency excitation in the presence of a single frequency excitation, so as to provide a desired multifrequency excitation of support element 781, and thus also of ring element 729. Due to the juxtaposition of ring element relative to screen element 728, the multifrequency excitation is transmitted thereto, and also to material being screened.

Due to the mutually opposing portions of the multifrequency converter units 3448, however, there exists an excitation phase shift therebetween, thereby to provide a dynamic boosting of the multifrequency vibration that would otherwise result. A further advantage in the present embodiment of the invention is the simplification of assembly and tuning of the system, due to a relatively small number of components. The operation of this vibratory separator is generally as described above in conjunction with FIGS. 13–16 and is thus not described specifically herein.

Referring now to FIG. 18, it is seen that support element 781 may be attached to bracket 735 via a further, intermediate elastic mount, referenced 790. Intermediate elastic mount 790 may be formed as any suitable elastic mount, by use of different types of springs, as well as rubber mounts and rubber-bonded-to-metal mounts. By way of example only, elastic mount 790 is seen to be formed of two elastomer portions 792' and 792", compressed by a central bolt 793 so as to provide, together with the elastomer portion 792' and 792", an elastic connection of support element 781 to bracket 735. Typically, proper selection of force-displacement characteristics of intermediate elastic mount 790 serves to provide optimum multifrequency excitation and vibration insulation characteristics, so as to enable vibratory separation of difficult-to-screen materials, in accordance with the method of the invention. Furthermore, fatigue durability of the separator is increased by vibratory isolation of brackets 735, and thus of housing 712, from high frequency oscillation of support element 781.

Figure 19A:
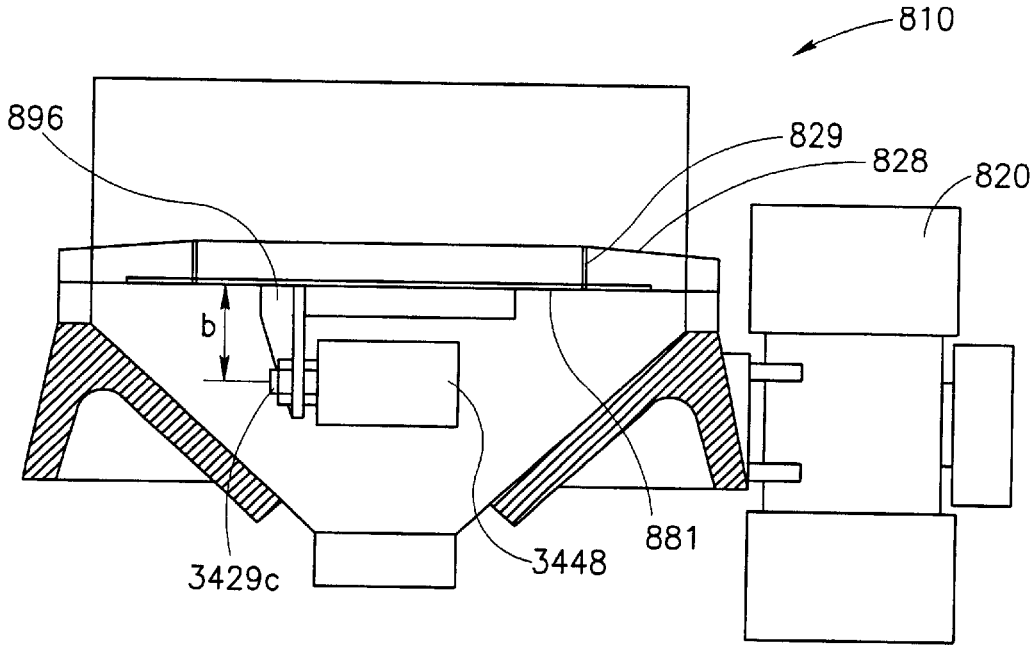
FIGS. 19A and 19B are sectional and plan views of an alternative type of tumbler vibratory separator, having a laterally disposed vibratory motor, and employing a multifrequency adapter system constructed in accordance with a further embodiment of the present invention.
Figure 19B:
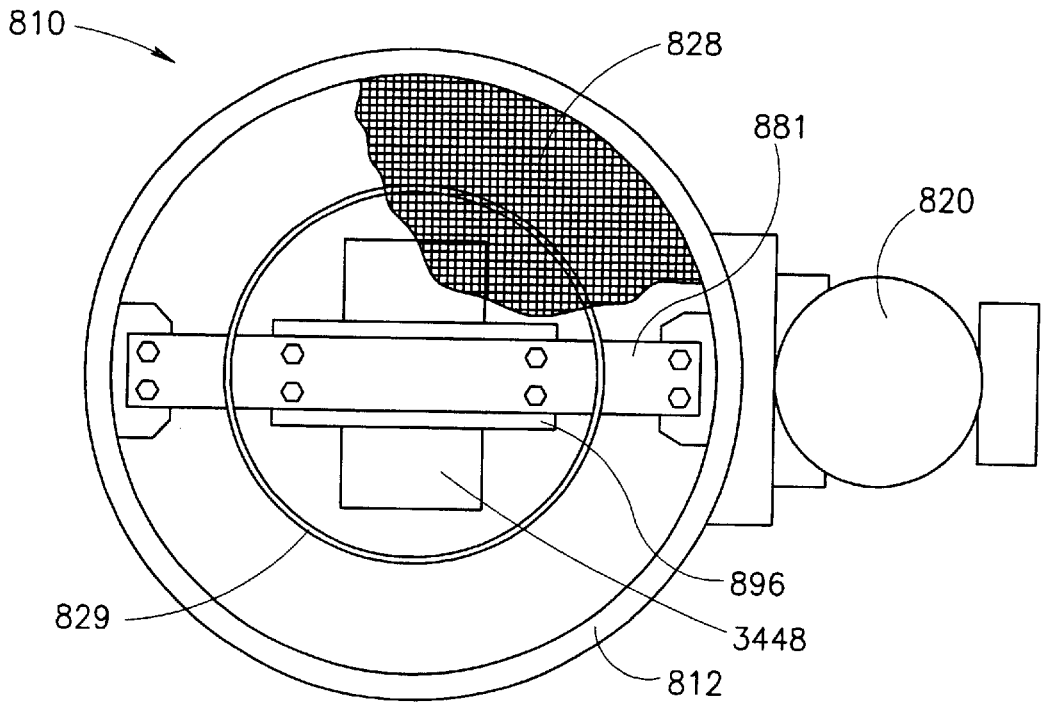

Referring now to FIGS. 19A–19B, there is shown, in accordance with a further embodiment of the invention, a tumbler vibratory separator, generally referenced 810, in which a laterally disposed vibrator motor 820 generates single frequency centrifugal force in the plane parallel to the surface of screen element 828. The present separator 810 is generally similar to separator 710, shown and described above in conjunction with FIGS. 17A–17B. Consequently, similar components and portions are denoted in FIGS. 19A and 19B by similar reference numerals, but bearing the prefix "8" in place of the prefix "7", and they are not specifically described again herein.

A single multifrequency converter unit 3448 is attached to support element 881 at its mid-section, by means of a rigid fastening bracket 896. The longitudinal axis of the threaded pin portion 3429*c* has an eccentricity relative to the plane of support element 881 by a distance b. The interface element 829, formed as a rigid ring, is attached to support element 881, and is further retained in prestressing contact with screen element 828, preferably with an elastomer lining (not shown) disposed therebetween. When vibrator motor 820 is operated, screen element 828 is subjected to a combined excitation. Firstly, screen element 828 is subjected to single frequency excitation via vibratable housing 812. Simultaneously therewith, however, multifrequency converter unit 3448 generates shock pulses, which are transformed to a multifrequency torque relatively to support element 881, which is essentially a product of the multifrequency excitation forces emanating from multifrequency converter unit 3448 and lever arm b. The torque is received by support element 881 and, due to a predetermined bending stiffness thereof, applies a corresponding multifrequency excitation to screen element 828, via interface element 829. By way of example only, in FIGS. 19A–19B the active axis of multifrequency converter unit 3448 is parallel to screen element 828, but generally the active axis may be inclined by an acute angle relative to the plane of screen element 828.

Figure 20:
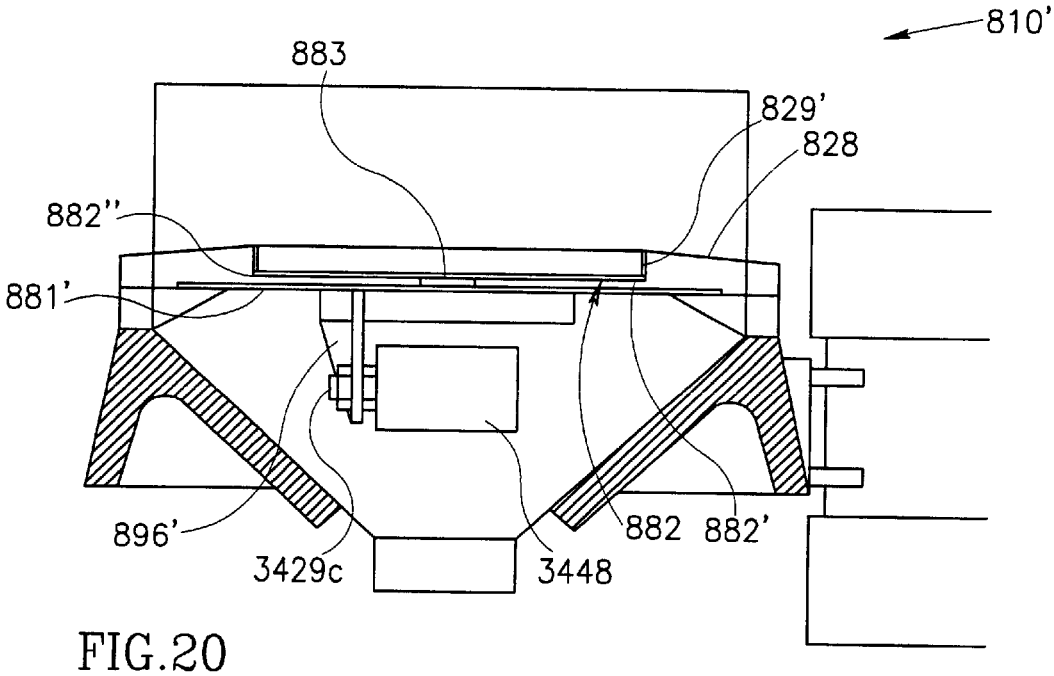
FIG. 20 is a cross-sectional view of a tumbler vibratory separator, employing a multifrequency adapter system constructed in accordance with yet a further embodiment of the present invention, and which includes main and additional interface elements for connection of the illustrated multifrequency converter assembly to the interface element.

Referring now to FIG. 20, there is shown a separator 810', which is generally similar to separator 810, shown and described above in conjunction with FIGS. 19A and 19B, and is thus described herein only with regard to the differences therebetween. Accordingly, corresponding components and portions are denoted in FIG. 20 by corresponding numerals, but with the addition of a prime (') notation.

In the present embodiment, it is seen that there is provided an additional elastic element 882 of predetermined stiffness as an intermediate link between interface element 829' and elastic support element 881'. Element 881' is shaped as a flat 'leaf spring' with a predetermined stiffness according to the torque vector which is normal to the longitudinal axis and coplanar to its plane. Additional elastic element 882 has first and second ends, respectively referenced 882' and 882", which are fixedly connected to the interface element 829', as by welding. Additional elastic element 882 is connected at its middle section to the middle section of support element 881' as by a spacer 883, such as a washer. Such a construction makes it possible to incrementally boost the multifrequency vibration of interface element 829' so as to select it in accordance with the mass of the material being screened, bearing in mind the interaction with the various components of the oscillation system.

Figure 21A:
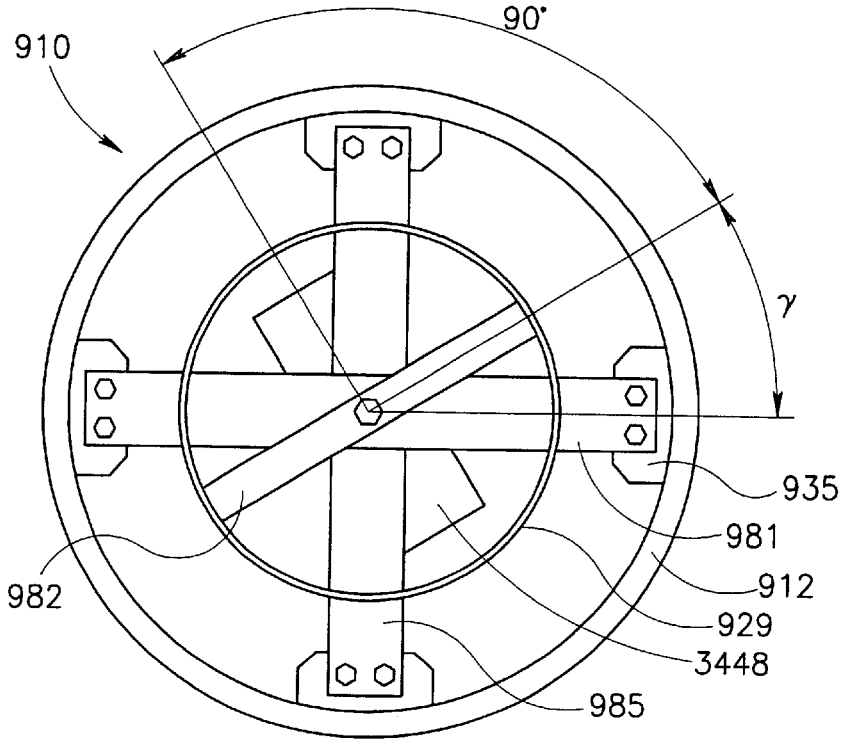
FIG. 21A is a schematic plan view of a construction similar to that of FIGS. 19A–19B, but having an additional interface element and an actuator element, wherein the additional interface element is arranged at an adjustable angle $\gamma$ to the main interface element.

Referring now to FIG. 21A, there is shown a vibratory separator, referenced generally 910, constructed in accordance with yet a further alternative embodiment of the present invention. Separator 910 is generally similar to separator 810, shown and described above in conjunction with FIG. 19, common portions and components bearing similar reference numerals, but having a "9" prefix.

In the present embodiment, there are provided first and second mutually orthogonal leaf springs, respectively referenced 981 and 985, of which first leaf spring 981 has a greater stiffness than second spring 985. First and second leaf springs 981 and 985 are mounted onto brackets 935 which are rigidly fastened to housing 912 as by welding or bolting. interface element 929 has an additional, flexible, 'leaf spring' type, connecting element 982 attached thereto. Element 982 may be rotated, so as to set its angle at $\gamma$ with respect to the longitudinal axis of multifrequency converter unit 3448, thereby to dictate the plane in which interface element 929 is activated. It is preferable that the rigid actuator (not shown) of multifrequency converter unit 3448 vibrates in the same activation plane as the interface element 929, as defined by angle $\gamma$.

The ability to select the angle $\gamma$ so as to be in the range 0–90° advantageously enables selection of an optimum multifrequency vibration mode, for separation of specific types of bulk materials. In particular, the acceleration spectrum density of the multifrequency converter vibration of the screen element may be significantly influenced by the magnitude and duration of the shock pulses, transferred by interface element 929. An angle $\gamma$ of 0 and 90 represent the extreme operating conditions of separator 910. These two extremes provide the optimum working modes for efficient screening of powder materials such as fine metal powders, and the disintegrating sifting of various pharmaceutical powders inclined to agglomerate, and so on. Furthermore, the vibratory separator 910 of the present embodiment is adjustable in accordance with production requirements, enabling preselection of a screening regime in accordance with the type of material to be screened.

Figure 21B:
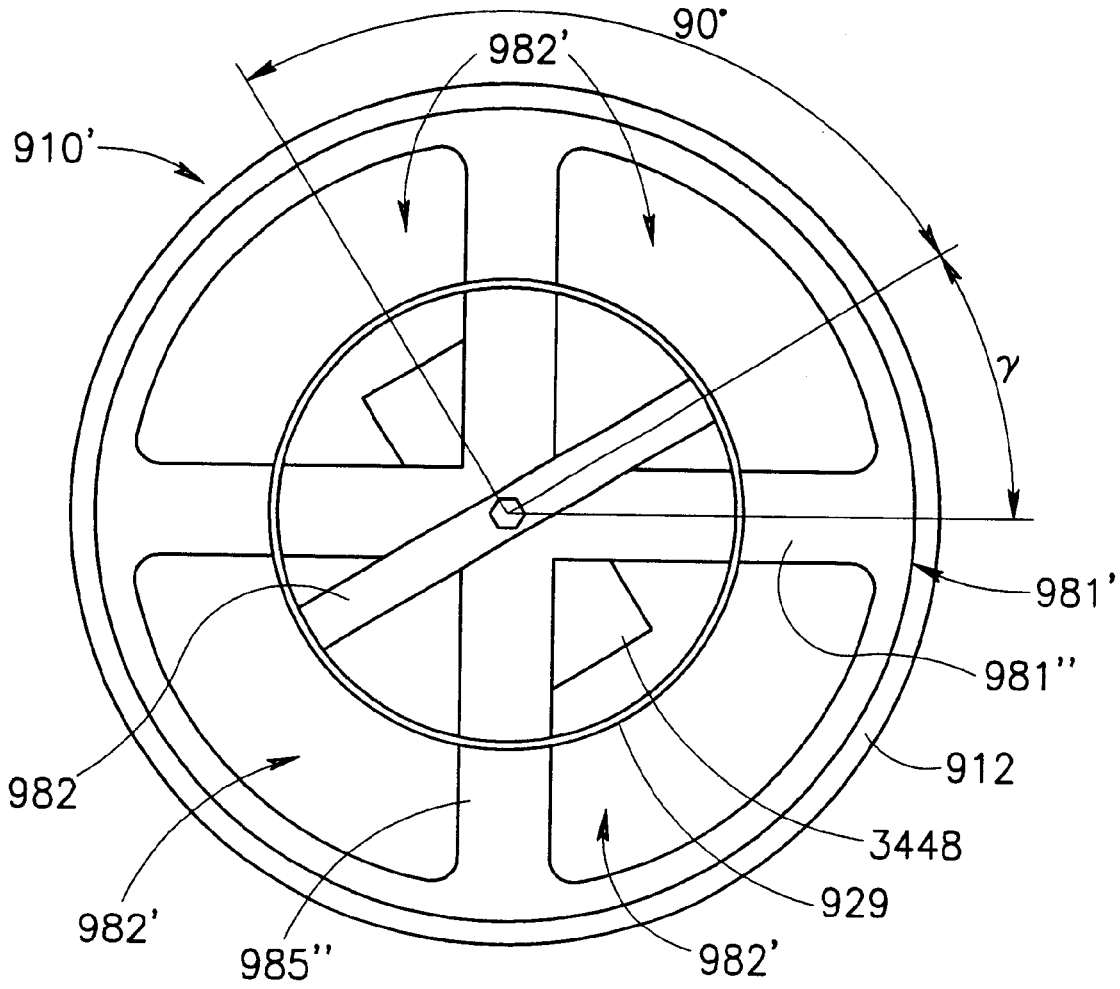
FIG. 21B is a schematic plan view of a construction generally similar to that of FIG. 21A, but employing an integral, flexible actuator element.

Referring now to FIG. 21B, there is seen a vibratory separator 910' which is generally similar to that shown and described above on conjunction with FIGS. 21A, except that, in place of first and second mutually orthogonal leaf springs 981 and 985, respectively, a single, unitary resilient element 981' is provided. Element 981' has formed therein a plurality of sector-shaped cutouts 982', thereby to define a pair of integrally formed crossed portions 981" and 985".

Figure 22A:
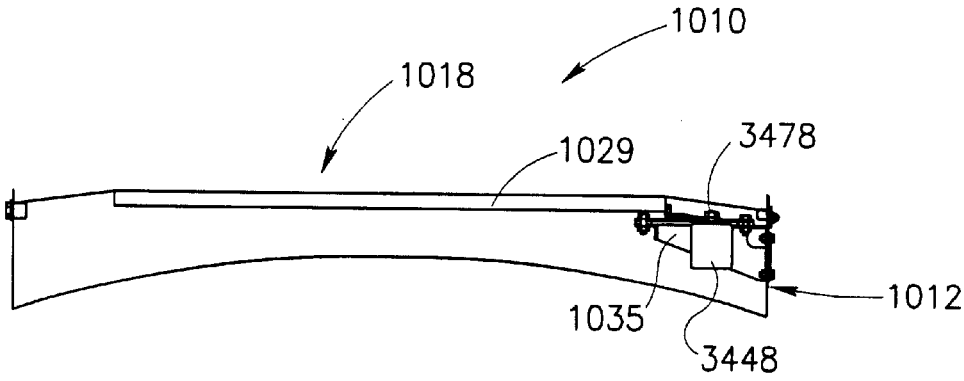
FIGS. 22A, 22B and 22C are a sectional view, plan view and enlarged partial cross-sectional view of a further embodiment of the multifrequency adapter system employed in a tumbler separator, and having a ring-shaped actuator element.
Figure 22B:
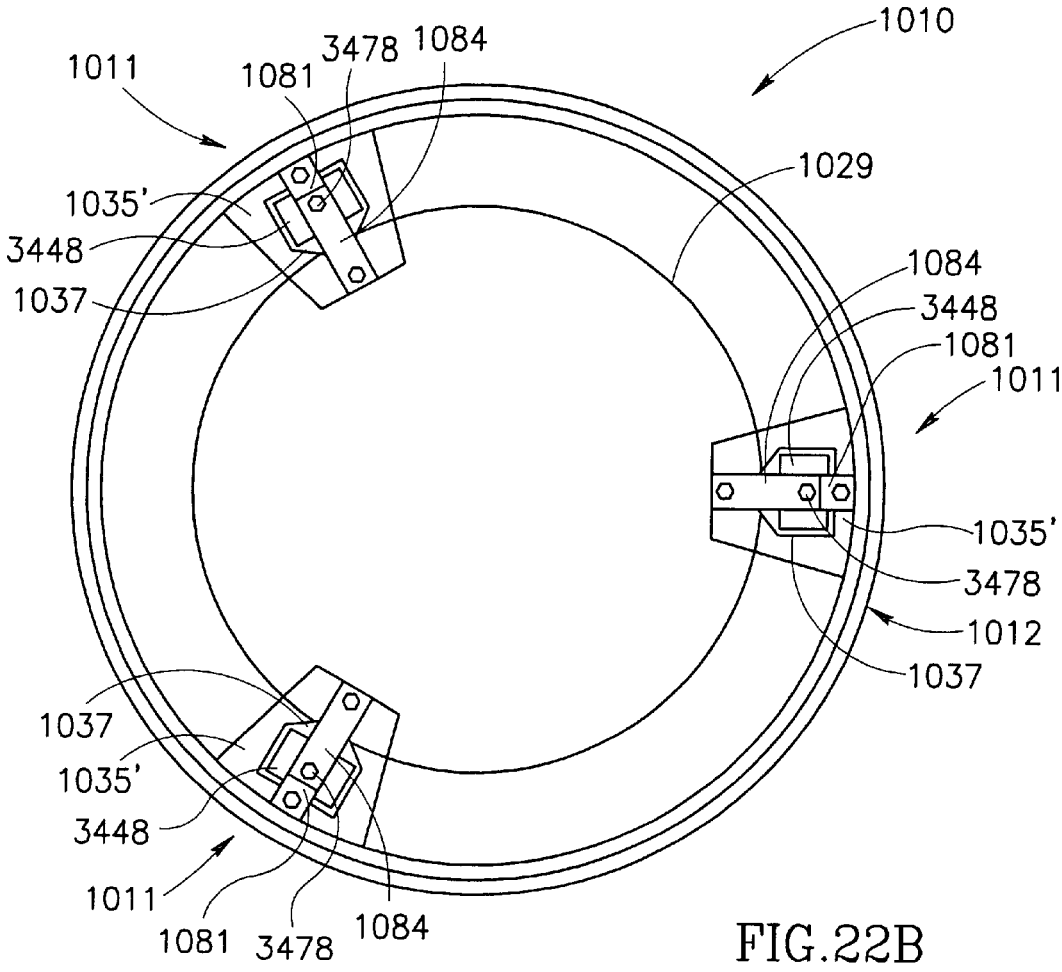
Figure 22C:
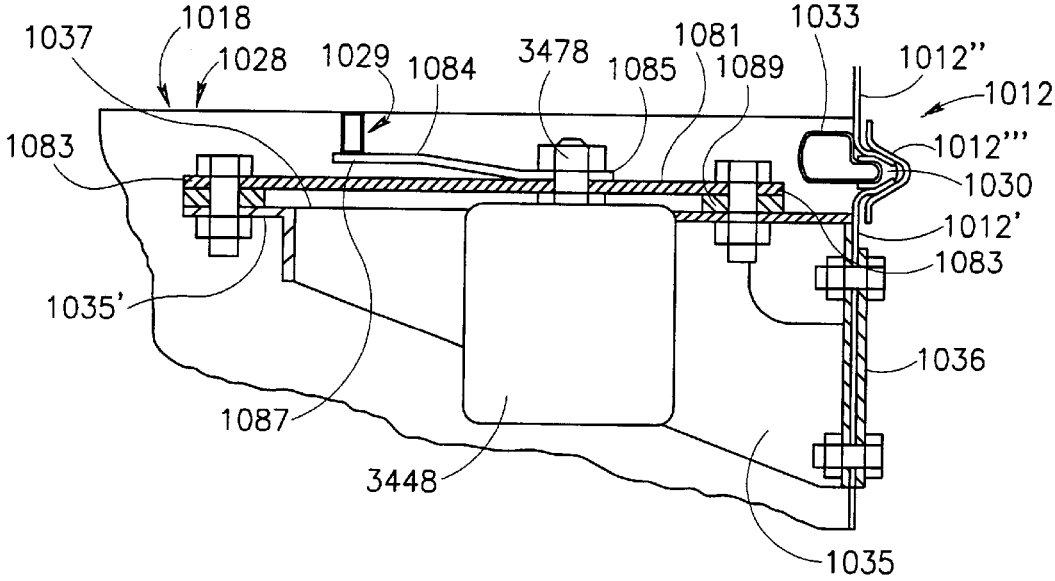

Referring now to FIGS. 22A–22C, there is shown a vibratory separator, referenced generally 1010, constructed in accordance with yet a further alternative embodiment of the present invention. Separator 1010 is generally similar to separator 710, shown and described above in conjunction with FIGS. 17A and 17B, common portions and components bearing similar reference numerals, but having a "10" prefix.

The ring-shaped housing portion, referenced generally 1012, is formed, as seen in the enlarged view of FIG. 22C, of a main housing portion 1012', an upper housing portion 1012", generally surrounding the screen assembly 1018, and an intermediate ring portion 1012'", which serves to attach the upper and main housing portions 1012" and 1012', so as to clamp therebetween a peripheral frame 1033 of screen assembly 1018, via a peripheral elastic element 1030.

As seen in FIG. 22B, the separator is divided into three regions, preferably equal, by a plurality of adapter locations 1011 whereat integrated multifrequency converter units 3448, are positioned. At each such location, there is provided an angle bracket (FIG. 22C) or equivalent, referenced 1035, which are bolted, welded or otherwise fixedly attached to the main housing portion 1012', via a suitable double wall construction 1036, or the like.

As seen in FIG. 22B, upper, generally planar portions 1035' of brackets 1035 are formed with cutouts 1037 so as to enable positioning therein of elastic joint elements 1081. Joint elements 1081 are formed as 'leaf springs,' generally as described hereinabove, and are connected at both ends 1083 thereof, radially across the cutouts 1037, to predetermined portions of upper planar bracket portions 1035', typically employing a washer 1089 as a spacer. Each joint element 1081 has suspended therefrom multifrequency converter unit 3448, via its threaded pin portion 3478.

A ring-shaped interface element 1029 is associated with elastic element 1081 and multifrequency converter unit 3448 via a bent leaf spring 1084, having first and second ends, respectively referenced 1085 and 1087. The first end 1085 of each leaf spring 1084 is fastened to an associated elastic joint element 1081 and to the threaded pin portion 3478 of an associated multifrequency converter unit 3448. The second ends 1087 of the bent leaf springs 1084 are arranged, as seen in FIG. 22C, to support interface ring 1029 in touching, excitation transmission association with screen assembly 1028, generally, and with screen element 1028, in particular, preferably via an elastomer lining (not shown).

It will be particularly noted that, in the present embodiment too, interface element 1029 is pressed against the underside of screen element 1028, thereby to apply a prestressing force thereto. The prestressing force may be adjusted by use of spacers 1035 of different thicknesses. Operation of the vibratory separator according to proposed method of present invention is generally as described above in conjunction with FIGS. 13–15, and is thus not described again, herein.

Referring now generally to the embodiments of the present invention shown and described above in conjunction with FIGS. 19A–22C, in which the screen element is prestressed, it should be noted that, in accordance with predetermined relationships between inertial and stiffness parameters, the separator's oscillating system is able to interact with a processed material at the manner which corresponding to the intensity of the activation provided by the multifrequency converter means. The systems are constructed such that this interaction is sufficiently intense so as to provide self-cleaning.

Figure 23A:
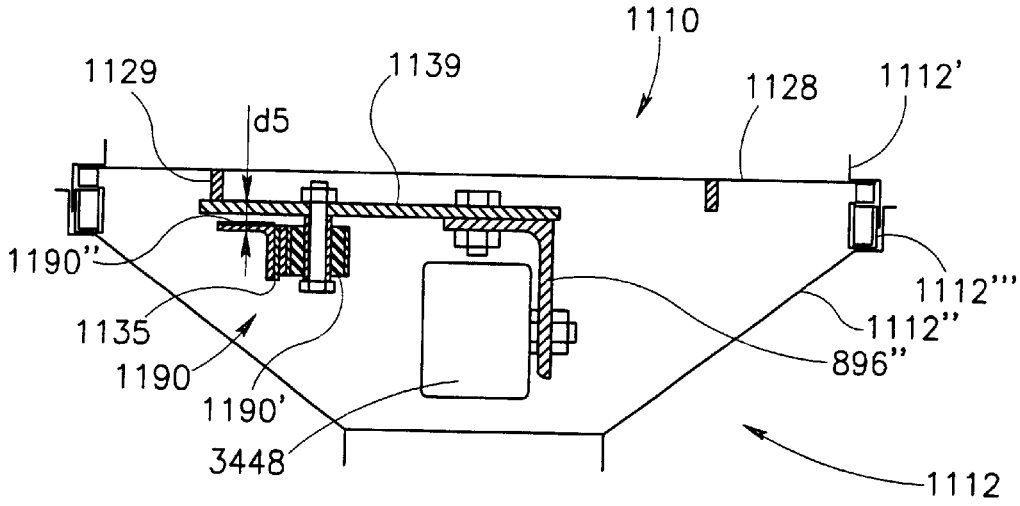
FIGS. 23A and 23B are sectional and plan views of a vibratory separator employing a single multifrequency converter unit in accordance with a further embodiment of the invention.
Figure 23B:
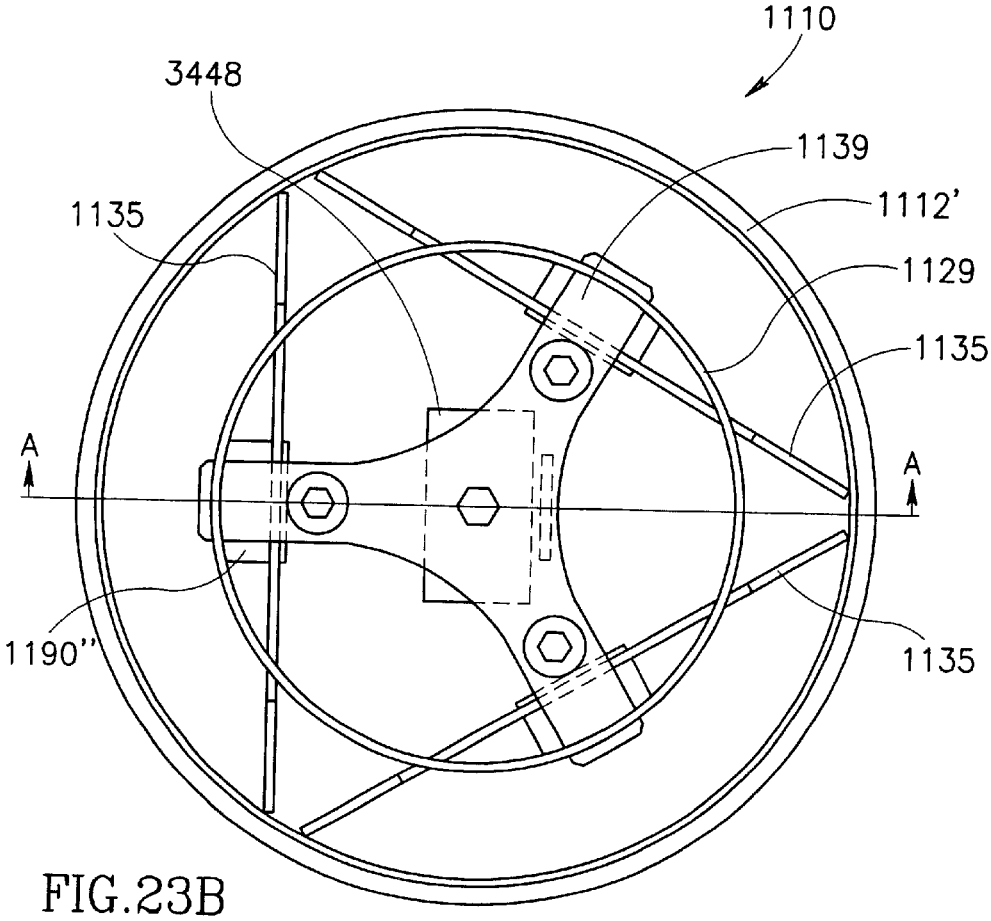

Referring now to FIGS. 23A–23B, there is shown, in accordance with a further alternative embodiment of the invention, a vibratory separator, referenced generally 1110, having a multifrequency adapter system with a single multifrequency converter unit 3448. Separator 1110 has a laterally disposed vibrator motor (not shown) and is generally similar to separator 810, shown in FIGS. 19A–B.

It is seen that an interface support element 1139 is a trefoil-shaped stiff flat plate, which is attached to brackets 1135, via intermediate elastic mounts, referenced generally 1190 (FIG. 23A). Interface support element 1139 carries a ring-shaped interface element 1129, attached thereto as by welding. Brackets 1135 are connected to a ring frame portion 1112''', which is arranged between upper housing portion 1112' and a lower housing portion 1112'' of housing 1112. The intermediate elastic mounts 1190 are shaped as a combination of intermediate elastic bush portions 1190' and intermediate elastic buffer portions 1190'', the latter having the gap designated d5 (FIG. 23A) for limitation of the displacement of movable parts of the system. A single multifrequency converter unit 3448 is attached to interface support element 1139 at its mid point by means of a fastening bracket 896''.

During assembly of the system, sieve element 1128 is pre-stressed from beneath by interface element 1129. When housing 1112 is activated by single frequency vibrator motor (not shown), the converter unit 3448 transforms the single frequency vibration of housing 1112 to a sequence of shock pulses, thereby transmitting the multifrequency excitation to interface support element 1139, and further to the ring-shaped interface element 1129, to sieve element 1128, and to the material to be screened. Dynamic parameters of the multifrequency adapter system are predetermined so as to provide a level of multifrequency energy which is required for de-agglomeration of particle agglomerates, and for self-cleaning of the sieve cloth. Intermediate elastic mounts 1190 may be formed as any suitable springs, rubber or rubber-metal composite elements having necessary stiffness and dissipation parameters.

Figure 24A:
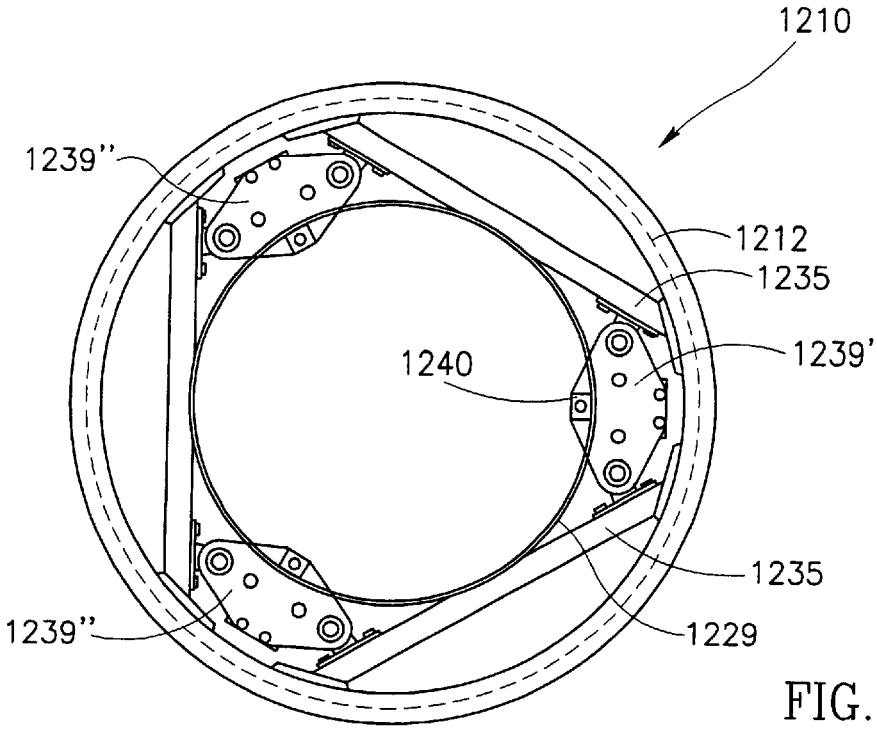
FIGS. 24A and 24B are a plan view and an enlarged cross-sectional view of a tumbler vibratory separator incorporating a multifrequency adapter system, constructed in accordance with yet one further embodiment of the invention.
Figure 24B:
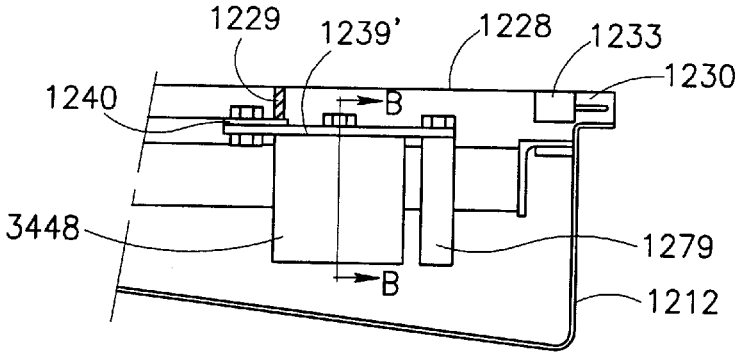
Figure 24C:
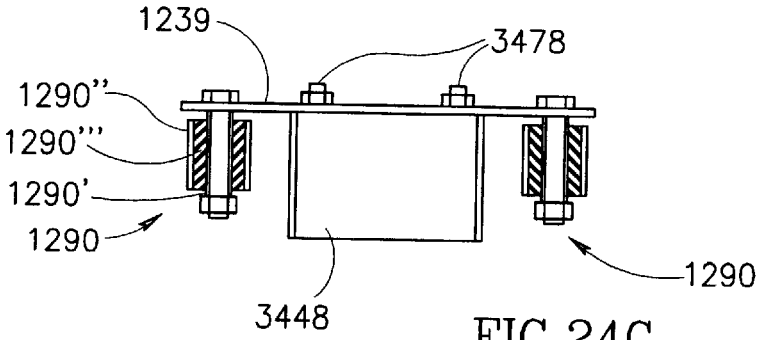
FIG. 24C is a partially enlarged view of an interface support element, multifrequency converter unit and intermediate elastic mounts seen in FIGS. 24A–B and taken along line B—B therein.

Referring now to FIGS. 24A–C, there is shown a further embodiment of a tumbler vibratory separator, referenced generally 1210, which is generally similar to the separator 1010, shown and described above in conjunction with FIGS. 22A–C. The multifrequency adapter system illustrated herein has a ring-shaped interface element 1229, which is connected to several peripherally arranged interface support elements 1239', 1239'' and 1239''' via a plurality of connecting portions 1240 as by bolted connections. Furthermore, each of the interface support elements 1239', 1239'' and 1239''' supports multifrequency converter unit 3448, and an associated counter-balance mass 1279. The interface support elements 1239', 1239'' and 1239''' are shaped as rigid flat plates, connected to housing portions 1235 by means of intermediate elastic mounts, referenced generally 1290. The intermediate elastic mounts 1290 are preferably shaped as elastic bushes, each having an elastomer hub 1290''', and inner metal rod portions 1290' which are fastened to interface support elements 1239 as by bolted connection. Outer flange portions 1290'' of the intermediate elastic mounts 1290 are attached to brackets 1235, rigidly connected to housing 1212. It is clear that intermediate elastic mounts 1290 may be any suitable elastic elements formed of metal, rubber-metal mounts, or any other composite constructions, which permit a suitable multifrequency excitation of the sieve element and proper vibratory insulation of housing 1212. In the present embodiment, it is seen that sieve element 1228 is attached to a peripheral frame 1233 which is connected to the housing via a U-shaped elastomer gasket 1230. Additionally, the adapter system is assembled in such a way that the rigid interface element 1229 is initially pre-stressed against the sieve element 1228 from beneath.

The operation of the separator 1212 is generally as described above in conjunction with FIG. 16 and FIGS. 22A–C and is thus not described specifically herein.

Figure 25:
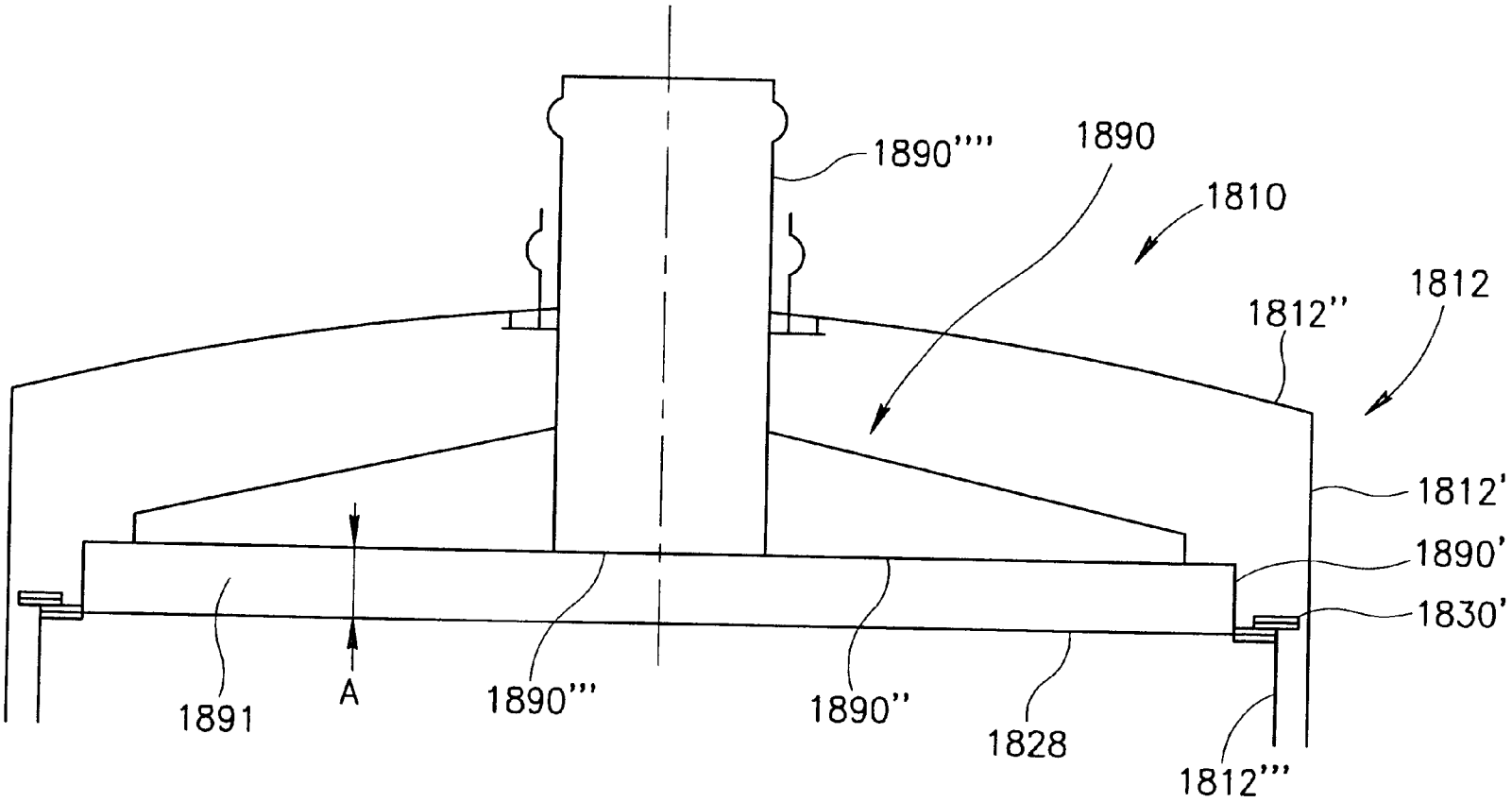
FIG. 25 is a partial schematic cross-sectional view of the upper part of a vibratory separator equipped by reflecting apparatus designated 1890 and configured as flat plate arranged parallel to the screen assembly and constructed in accordance with yet a further embodiment of the invention.

Referring now to FIG. 25 there is illustrated a tumbler separator, referenced generally 1810, in which there is seen reflecting apparatus, referenced generally 1890. Apparatus 1890 is arranged inside a housing 1812, and is positioned between a housing cover portion 1812'', a tumbler portion 1812', and an upper screen assembly, generally 1828. A multifrequency adapter system (not shown), substantially as shown and described hereinabove, is arranged beneath the screen assembly 1828.

Reflecting apparatus 1890 is configured as a flat reflector plate 1890'', hermetically connected via a ring portion 1890' and a gasket, or other equivalent sealing member portion 1830, to the periphery of the screen assembly 1828 attached to the screen deck 1812'''. There is also provided a feed inlet 1890'''', attached to the flat plate 1890'' and forming therein a feed opening 1890'''. Reflecting plate 1890'' is arranged in parallel spaced relation to screen assembly 1828, by a normal distance D, between the upper surface of the screen assembly and lower surface of the plate 1890''.

Preferably, distance D is greater than the relative amplitude A of the screen, and less than the half-height of the free flight of particles under the upper surface of the screen that would occur in the absence of the reflecting apparatus, and assuming zero or negligible air resistance. Accordingly, distance D may be calculated in accordance with the equation:

$$D=0.25*V^2/g,$$

where V is the taking-off (launching) velocity of the agglomerated particle, and g is gravitational acceleration.

Upon activation of the vibrator motor (not shown), the adapter system (also not shown) converts a single frequency vibration of the housing 1812 into multifrequency vibration of the screen assembly thus providing high level acceleration to material particles to be screened. Particulate material including particle agglomerates is fed via feed opening 1890''' Due to multiple random collisions of material agglomerates against the upper surface of the screen assembly 1828 and lower surface of the reflecting plate 1890'' the particle agglomerates disintegrate. Simultaneously, movement of particulate material at the chamber 1891 configured between the screen assembly 1828 and reflecting apparatus 1890, creates an essential pulsation of the air pressure above the screen assembly 1828, thus quickening passage of broken particles via the screen openings and promoting self-cleaning of these openings. This combined action has been found to be used for dry control screening of micron sized difficult to screen powders inclined to agglomeration, which cannot be screened by other, known dry sizing techniques.

Vibratory separation in accordance with the present invention, is performed as per the following sequence of operations:

1. introducing material to the inlet of the screen assembly;
2. imparting single frequency vibration of the vibratable housing by a single frequency excitation source, thereby to deliver single frequency vibration to the screen element via the housing;
3. movement of particles along the screen element so that small particles (sub-mesh size) pass through the screen element and exit via the first outlet;
4. movement of larger particles along the screen element to as to discharge via the second outlet;
5. simultaneous conversion of the single frequency vibration to multifrequency excitation by the multifrequency converter means, so that the rigid actuators of the multifrequency converter means transfer continuous sequences of mechanical shock pulses to the interface apparatus, thereby causing a corresponding multifrequency vibration of the screen element so as to promote passage of smaller particles through the openings of the screen assembly, preventing particulate solids from clogging up screen openings, and providing disintegration of particle agglomerates into single particles.

It will be appreciated that the method of vibratory separation, in accordance with an embodiment of the present invention, employs a combined multifrequency excitation of the screen or sieve surface, which is based on using the characteristics of the nonlinear oscillation system of the present invention, in which:

1. resonant boosting of vibration of the forced frequency of the vibrator is stable at a wide range relatively to the fluctuation of the material mass and parameters of the elastic or resilient elements, that makes possible use of resonant boosting for industrial screen separators;
2. vibration at the main frequency $\omega$ is accompanied by vibration of combined multiple frequencies $2\omega$, $3\omega, \ldots, n\omega, \ldots$, so that energizing of high frequency components essentially exceeds the main frequency vibration;
3. the peak acceleration caused by the high frequency components, may be at least an order of magnitude greater than the main frequency acceleration.

The present method of vibratory separation includes the superposition of multifrequency vibration generated by sequences of shock pulses on normal vibratory excitation, obtained by use of a conventional, single frequency vibrator motor. Such shock pulses, being applied to the screening assembly at different angles and with shifted phases, cause multifrequency vibration with wide band spectrum, of a randomly continuous or close to discrete type. Since the magnitude of acceleration is proportional to the square of the frequency, it is evident that high frequency components of the Fourier expansion raises the sieve surface to its maximum acceleration, causing extensive inertial forces acting on particles stuck or wedged at the opening of the sieve. It cause these particles 'to dance' in the openings without becoming firmly settled in it. This combined multifrequency vibration forces the wedged particles to be thrown up and away from the openings and it moves these particles to be mixed and discharged together with the oversized material.

Furthermore, the method of separation in accordance with the present invention efficiently eliminates adhesion of wet and sticky particles to the sieve surface, due to combined multifrequency vibration imparting high level of peak acceleration and corresponding high level inertial forces. These forces overcome intermolecular and electrostatic adhesion forces eliminating blinding of the sieve openings and promoting disintegration of particle agglomerates for those materials which have a tendency to form agglomerates.

It should further be noted that the above-described multifrequency converter apparatuses and units, together with the interface apparatuses and elements shown and described hereinabove, may be easily attached to existing separator, currently employed at single-frequency mode. After such attachment the modified machine is able to perform the highly efficient multifrequency screening of difficult-to-screen materials according to the separation method of the present invention. Such a method allows to utilize an usual standard screen element without any modifications, per se.

Particulate and powder materials to be screened are distinguished by great diversity of particle sizes, shapes, characteristic properties, and so on. Also there is an enormous variety of industrial demands as to the cut size, throughput, and quality of the undersized and oversized products. Numerous screening trials, performed by the Inventors using diverse particulate and powder materials, enable the selection of optimum conditions and methods for vibratory separation of different materials, providing different operating modes of imparting the shock pulses and multifrequency vibrations. These modes are achieved by combinations of the waveforms, time shifts, relative geometry and points of application of the pulses.

It will be appreciated that above mentioned sequences of the shock pulses may have discrete or continuous spectra. In accordance with the present invention, the shock pulses, generated by the described multifrequency converter apparatuses, may be imparted unilaterally towards or opposite to the contact portion of the interface apparatus.

The method of vibratory separation according to present invention is, furthermore, optimum for tumbler vibratory separators, where the shock pulses from different multifrequency converter means are applied with different phase shift angles since single frequency vibration of the support portions of the multifrequency converter apparatuses have the different phases at different points. In a case in which one or more diametrically opposed pairs of multifrequency converter units are employed, the separation method of the invention employs each such pair to impart mutually anti-phase shock pulses.

It will be appreciated that the shock pulses may also be applied bilaterally, thus randomizing 'dancing' of particles wedged in the screen openings, thus increasing the probability of peak pulses in a desired direction, and further enhancing unclogging of the sieve. For these conditions to obtain, the shock pulses acting towards the screen assembly and the pulses acting at opposite direction may be have an equal or unequal duration and magnitudes. Additionally, shock pulses may be applied normally or at an acute angle to the plane of the screen element, so as to cause in-plane waves at the screen fabric, which continuously change the shape of the openings, thus preventing blockage of the openings by the near-sized particles.

It will thus be appreciated by persons skilled in the art, that the scope of the present is not limited to what has been specifically shown and described hereinabove, merely by way of illustrative example. Rather, the scope of the present invention is limited solely by the claims, which follow:

What is claimed is:

1. A multifrequency vibratory adapter system for use with a vibratory separator, the vibratory separator including a housing formed with an inlet for material to be screened, a first outlet for discharge of undersized particles, and a second outlet for discharge of oversized particles; one or more screens supported in the housing between the inlet and the first outlet such that material entering the housing through the inlet engages the at least one screen, and wherein undersized particles pass through the one or more screens and exit the housing through the first outlet, whereas oversized particles do not pass through at least one of the one or more screens and exit the housing through the second outlet; and a source of single frequency vibratory excitation for exciting the separator so as to screen particulate material provided thereto, said multifrequency vibratory adapter system includes:

at least one interface apparatus mounted in excitation transmitting contact with an associated screen; and at least one multifrequency converter unit, arranged in excitation conducting association with said at least one interface apparatus, operative to produce a multifrequency excitation when exposed to a single frequency excitation, thereby to cause a corresponding multifrequency excitation of said at least one interface apparatus, and thus also, of the associated screen, wherein each of said at least one multifrequency converter unit includes:

at least one actuator element for conducting excitation energy to said at least one interface apparatus; and resilient attachment apparatus for attaching said at least one actuator element to a support portion, and said adapter system also includes:

apparatus for mounting said support portion in association with said housing; and at least one elastic buffer apparatus, arranged between said at least one actuator element and said at least one interface apparatus, for adjusting in non-linear fashion, the characteristics of the multifrequency excitation transmitted therebetween, wherein said multifrequency vibratory adapter system is associated with a predetermined one of the one or more screens.

2. A multifrequency vibratory adapter system according to claim 1, wherein said apparatus for mounting said support portion includes resilient mounting apparatus for mounting said support portion in resiliently excitable association with the housing.

3. A multifrequency vibratory adapter system according to claim 1, wherein said resilient attachment apparatus is characterized by having non-linear force displacement characteristics, and is operative to produce a multifrequency excitation of said at least one actuator element, when subjected to a single frequency excitation, so as to provide an excitation of amplitude sufficient to cause said at least one actuator element to strike said at least one buffer apparatus.

4. A multifrequency vibratory adapter system according to claim 1, wherein said resilient attachment apparatus includes a pair of integral resilient mountings, each having first and second resilient bush portions, wherein each said resilient bush portion includes first and second portions arranged for relative rotation about a common axis, and wherein said first portions of said first and second resilient bush portions are connected to each other, a first of said second portions is connected, at least indirectly, to said support portion, and a second of said second portions is connected to said at least one actuator element.

5. A multifrequency vibratory adapter system according to claim 1, wherein said at least one actuator element is mounted relative to one of said at least one interface apparatus such that, when in an at-rest position, said at least one actuator element is in non-touching, association with said interface apparatus, and, when subjected to said excitation, each at least one actuator element repeatedly strikes and thus causes a corresponding multifrequency excitement of said at least one interface apparatus, thereby to cause a corresponding multifrequency excitation of the associated screen, and of any particulate material sought to be screened thereby.

6. A multifrequency vibratory adapter system according to claim 1, wherein said at least one actuator element is mounted relative to one of said at least one interface apparatus such that, when in an at-rest position, said at least one actuator element is in touching, association with said interface apparatus, and, when subjected to said multifrequency excitation, each at least one actuator element repeatedly strikes and thus causes a corresponding excitation of said at least one interface apparatus, thereby also to cause a corresponding multifrequency excitation of the associated screen, and of any particulate material sought to be screened thereby.

7. A multifrequency vibratory adapter system according to claim 1, wherein each said at least one interface apparatus is configured and arranged with respect to the screen associated therewith such that, when subjected to said multifrequency excitation, each said at least one interface apparatus is operative to transmit said multifrequency excitation to a predetermined area of the screen, through which particulate material is sought to be passed.

8. A multifrequency vibratory adapter system according to claim 1, wherein each said interface apparatus is formed of at least two members, of which at least one is adjustable with respect to the at least one other, thereby adjusting the characteristics of the multifrequency excitation of the associated screen.

9. A multifrequency vibratory adapter system according to claim 1, wherein each said at least one multifrequency converter unit has a rigid casing formed thereabout, and wherein each said interface apparatus includes at least a portion of said casing.

10. A multifrequency vibratory adapter system according to claim 9, wherein each said interface apparatus further includes an interface element arranged in direct excitation contact with the screen associated therewith, and further includes intermediate interface apparatus for transmitting multifrequency excitation from said casing to said interface element.

11. A multifrequency vibratory adapter system according to claim 10, wherein said intermediate interface apparatus includes a rigid intermediate element connecting between said casing and said interface element.

12. A multifrequency vibratory adapter system according to claim 10, wherein said intermediate interface apparatus includes a resilient intermediate element connecting between said casing and said interface element.

13. A multifrequency vibratory adapter system according to claim 1, and also including apparatus for tensioning each of the one or more screens.

14. A multifrequency vibratory adapter system according to claim 13, and wherein said apparatus for tensioning each of the one or more screens includes apparatus for supporting said interface element thereagainst.

15. A multifrequency vibratory adapter system according to claim 14, wherein said apparatus for tensioning is adjustable.

16. A vibratory separator which includes:

a housing formed with an inlet for material to be screened, a first outlet for discharge of undersized particles, and a second outlet for discharge of oversized particles;

at least one screen supported in said housing between said inlet and said first outlet such that material entering said housing through said inlet engages at least a first of said at least one screen, and wherein undersized particles pass through said at least one screen and exit said housing through said first outlet, whereas oversized particles do not pass through at least one of said at least one screen and exit said housing through said second outlet;

a source of single frequency vibratory excitation for exciting the separator so as to screen particulate material provided thereto; and a multifrequency vibratory adapter system, which includes:

at least one interface apparatus mounted in excitation transmitting contact with said at least one screen; and at least one multifrequency converter unit, arranged in excitation conducting association with said at least one interface apparatus, operative to produce a multifrequency excitation when exposed to a single frequency excitation, thereby to cause a corresponding multifrequency excitation of said at least one interface apparatus, and thus also, of said screen, wherein each of said at least one multifrequency converter unit includes:

at least one actuator element for conducting excitation energy to each said interface apparatus; and resilient attachment apparatus for attaching said at least one actuator element to a support portion;

and said adapter system also includes:

apparatus for mounting said support portion in association with said housing; and at least one elastic buffer apparatus, arranged between said at least one actuator element and said at least one interface apparatus, for adjusting in non-linear fashion, the characteristics of the multifrequency excitation transmitted therebetween.

17. A vibratory separator according to claim 16, wherein said apparatus for mounting said support portion includes resilient mounting apparatus for mounting said support portion in resiliently excitable association with the housing.

18. A vibratory separator according to claim 16, wherein said resilient attachment apparatus is characterized by having nonlinear force displacement characteristics, and is operative to produce a multifrequency excitation of said at least one actuator element, when subjected to a single frequency excitation, so as to provide an excitation of amplitude sufficient to cause said at least one actuator element to strike said at least one buffer apparatus.

19. A vibratory separator according to claim 16, wherein said resilient attachment apparatus includes a pair of integral resilient mountings, each having first and second bush portions, wherein each said bush includes first and second portions arranged for relative rotation about a common axis, and wherein said first portions of said first and second bushes are connected to each other, and a first of said second portions is connected to said support portion, and a second of said second portions is connected to said at least one actuator element.

20. A vibratory separator according to claim 16, wherein said at least one actuator element is mounted relative to one of said at least one interface apparatus such that, when in an at-rest position, said at least one actuator element is in non-touching, association with said interface apparatus, and, when subjected to said excitation, each at least one actuator element repeatedly strikes and thus causes a corresponding multifrequency excitement of said at least one interface apparatus, thereby to cause a corresponding multifrequency excitation of said screen, and of any particulate material sought to be screened thereby.

21. A vibratory separator according to claim 16, wherein said at least one actuator element is mounted relative to one of said at least one interface apparatus such that, when in an at-rest position, said at least one actuator element is in touching, association with one of said at least one interface apparatus, and, when subjected to said multifrequency excitation, each at least one actuator element repeatedly strikes and thus causes a corresponding excitation of said at least one interface apparatus, thereby also to cause a corresponding multifrequency excitation of said screen, and of any particulate material sought to be screened thereby.

22. A vibratory separator according to claim 16, wherein each said at least one interface apparatus is configured and arranged with respect to said screen such that, when subjected to said multifrequency excitation, each said interface apparatus is operative to transmit said multifrequency excitation to a predetermined, area of said screen, through which particulate material is sought to be passed.

23. A vibratory separator according to claim 16, wherein each said interface apparatus is formed of at least two members, of which at least one is adjustable with respect to said at least one other, thereby adjusting the characteristics of the multifrequency excitation of said screen.

24. A vibratory separator according to claim 16, wherein each said at least one multifrequency converter unit has a rigid casing formed thereabout, and wherein each interface apparatus includes at least a portion of said casing.

25. A vibratory separator according to claim 24, wherein each said interface apparatus further includes a interface element arranged in direct excitation contact with said screen, and further includes intermediate interface apparatus for transmitting multifrequency excitation from said casing to said interface element.

26. A vibratory separator according to claim 25, wherein said intermediate interface apparatus includes a rigid intermediate element connecting between said casing and said interface element.

27. A vibratory separator according to claim 25, wherein said intermediate interface apparatus includes a resilient intermediate element connecting between said casing and said interface element.

28. A vibratory separator according to claim 16, and also including apparatus for tensioning said screen.

29. A vibratory separator according to claim 28, and wherein said apparatus for tensioning said screen element includes apparatus for supporting said interface element thereagainst.

30. A vibratory separator according to claim 29, wherein said apparatus for tensioning is adjustable.

31. A vibratory separator according to claim 16, wherein said apparatus for mounting said support portion is attached to said housing via at least one elastic attachment element.

32. A vibratory separator according to claim 16, wherein said at least one screen includes a plurality of screens each arranged as a different deck, each said screen having associated in combination therewith one of said at least one interface apparatus and at least one multifrequency converter unit, each said combination having excitation parameters different from excitation parameters of at least one other of said combinations.

33. A vibratory separator according to claim 16, and also including at least one reflecting apparatus, arranged inside said housing above the upper surface of said screen and in spaced association with respect to said screen, and said at least one reflecting apparatus has at least one feed opening for passage of particulate material to the upper surface of said screen.

34. A vibratory separator according to claim 33, wherein said at least one reflecting apparatus is configured as a shell having said at least one feed opening and the periphery of said shell is hermetically sealed with respect to the periphery of the screen associated therewith, and the normal distance between the upper surface of said screen and the lower surface of said shell is more than the relative amplitude of said screen and less than the half of the height of the free flight of agglomerated particles under the upper surface of the screen in the absence of the reflecting apparatus.

35. A vibratory separator according to claim 34, wherein said shell is formed as flat plate, which is generally parallel to the plane of said screen, associated therewith.

36. A vibratory separator according to claim 33, wherein upper cover is configured as reflecting apparatus for shattering particle agglomerates impacting thereagainst and for promotion of passage of small particles through said screen.

37. A method of separating particulate solids of larger and smaller sizes from each other in a vibratory separator having a housing formed with an inlet for material to be screened, a first outlet for discharge of undersized particles, and a second outlet for discharge of oversized particles; and one or more screens supported in the housing between the inlet and the first outlet such that material entering the housing through the inlet engages the one or more screens, and wherein undersized particles pass through the screen and exit the housing through the first outlet, whereas oversized particles do not pass through the one or more screens and exit the housing through the second outlet; wherein the method includes the following steps:

a) introducing the solids to be separated into the housing via the inlet;

b) imparting to the housing and thus also to the solids, via the one or more screens, a single frequency vibration, thereby to induce vibratory transportation of particulate solids along the one or more screens such that undersize particles pass therethrough towards the first outlet, and such that oversize particles pass therealong towards the second outlet; and c) converting the single frequency vibration of the housing, in excitation transmitting association with the one or more screens, into a sequence of mechanical pulses applied to an interface apparatus, thereby to generate a multifrequency vibration of the screen and thus also of masses of agglomerates in engagement with the one or more screens, thereby to cause de-agglomeration of the masses and so also as to prevent blockage of the one or more screens by particles, wherein the mechanical pulses are applied unilaterally away from the one or more screens.

38. A method according to claim 37, wherein said step of generating a multifrequency excitation includes the step of generating mechanical pulses from at least different sources, and to apply the mechanical pulse therefrom so as to have different phase shifts relative to the phase angle of the single frequency vibration of the housing.

39. A method according to claim 37, wherein the mechanical pulses are imparted towards the one or more screens and away therefrom.

40. A method according to claim 39, wherein the mechanical pulses acting towards the one or more screens, and the pulses imparted away therefrom are of different respective durations.

41. A method according to claim 39, wherein the mechanical pulses acting towards the one or more screens, and the pulses imparted away therefrom are of different, respective, magnitudes.

42. A method according to claim 37, wherein, in said step of generating, the mechanical pulses are imparted at an angle $\beta$ relative to the plane of each of the one or more screens, wherein $0<\beta<90$ degrees.

43. A method according to claim 37, wherein said step of generating multifrequency excitation includes the excitation of different portions of each of one or more screens under differing excitation parameters.

44. A method according to claim 37, wherein the vibratory separator additionally includes at least one reflecting apparatus, arranged inside said housing above the upper surface of said screen and in spaced association with respect to said screen, and said at least one reflecting apparatus has at least one feed opening for passage of particulate material to the upper surface of said screen, wherein said method further includes the following additional steps:

causing the disintegration of particle agglomerates multiple collisions thereof in a space between said screen and said reflecting apparatus associated therewith, and providing air pressure pulsations in the space between said screen assembly and said reflecting apparatus pulsations, thereby to force small particles through the openings of said screen.

45. A method according to claim 44, wherein said at least one reflecting apparatus is configured as a shell having said at least one feed opening and the periphery of said shell is hermetically sealed with respect to the periphery of the screen associated therewith, and the normal distance between the upper surface of said screen and the lower surface of said shell is more than the relative amplitude of said screen and less than the half of the height of the free flight of agglomerated particles under the upper surface of the screen in the absence of the reflecting apparatus.

46. A method according to claim 45, wherein said shell is formed as flat plate, which is generally parallel to the plane of said screen, associated therewith.

47. A method according to claim 44, wherein upper cover is configured as reflecting apparatus for shattering particle agglomerates impacting thereagainst and for promotion of passage of small particles through said screen.

* * * * *